US008641352B2

(12) United States Patent
Stutz

(10) Patent No.: US 8,641,352 B2
(45) Date of Patent: Feb. 4, 2014

(54) ENTRANCE GATE FOR AN AUTOMATIC PARKING GARAGE HAVING MECHANISM FOR CENTERING A VEHICLE ON THE ENTRANCE GATE

(75) Inventor: Fridolin Stutz, Lufingen (CH)

(73) Assignee: Skyline Parking AG, Winterthur (CH)

( * ) Notice: Subject to any disclaimer, the term of this patent is extended or adjusted under 35 U.S.C. 154(b) by 487 days.

(21) Appl. No.: 13/041,258

(22) Filed: Mar. 4, 2011

(65) Prior Publication Data

US 2011/0213493 A1 Sep. 1, 2011

Related U.S. Application Data

(63) Continuation-in-part of application No. 11/665,106, filed as application No. PCT/CH2005/000599 on Oct. 12, 2005, now abandoned.

(30) Foreign Application Priority Data

Oct. 13, 2004 (CH) ..... 1688/04

(51) Int. Cl.
*E04H 6/00* (2006.01)

(52) U.S. Cl.
USPC ..... 414/254; 414/255; 414/260; 414/263

(58) Field of Classification Search
USPC ..... 414/253–255, 260, 263; 254/93 L, 89 R
See application file for complete search history.

(56) References Cited

U.S. PATENT DOCUMENTS

| | | | |
|---|---|---|---|
| 2,789,710 | A | 4/1957 | Desjardins |
| 3,102,645 | A | 9/1963 | Roth |
| 4,968,208 | A | 11/1990 | Friberg et al. |
| 5,851,098 | A | 12/1998 | Buckenauer et al. |

FOREIGN PATENT DOCUMENTS

| | | | |
|---|---|---|---|
| CA | 2327989 | A1 | 6/2002 |
| EP | 0350464 | A | 1/1990 |

*Primary Examiner* — Michael McCullough
(74) *Attorney, Agent, or Firm* — CUSPA Technology Law Associates; Yi Li

(57) ABSTRACT

An entrance gate and an automatic parking garage having such an entrance gate are provided. The entrance gate includes a stationary ground plate; two trace plates thereabove, movable in the plane in any direction in a gliding manner, each for receiving thereon a front and rear wheel of a car; a stationary top plate above the trace plates, having two opposing cut-out windows, with each trace plate exposed through one window; and two centering plates above the top plate, on outer sides of the cut-out windows. The centering plates connect with and are driven by two drive units to affect synchronous counter-movements. When being driven toward each other, the centering plates touch outer sides of tires of a car resting on the trace plates and move the car toward a centerline of the entrance gate, until the centerline of the car is aligned with the centerline of the entrance gate.

20 Claims, 20 Drawing Sheets

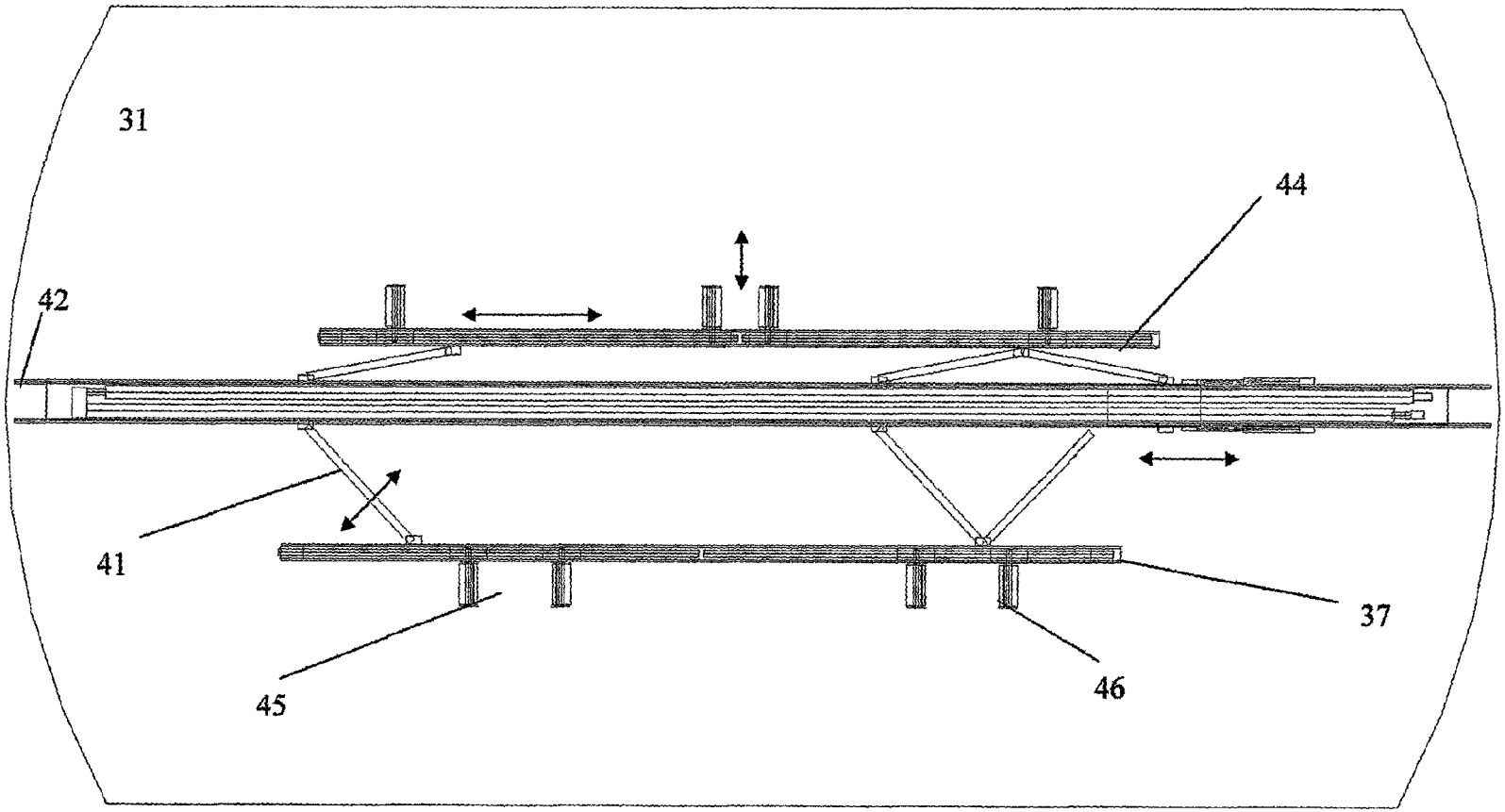
Fig. 4a1

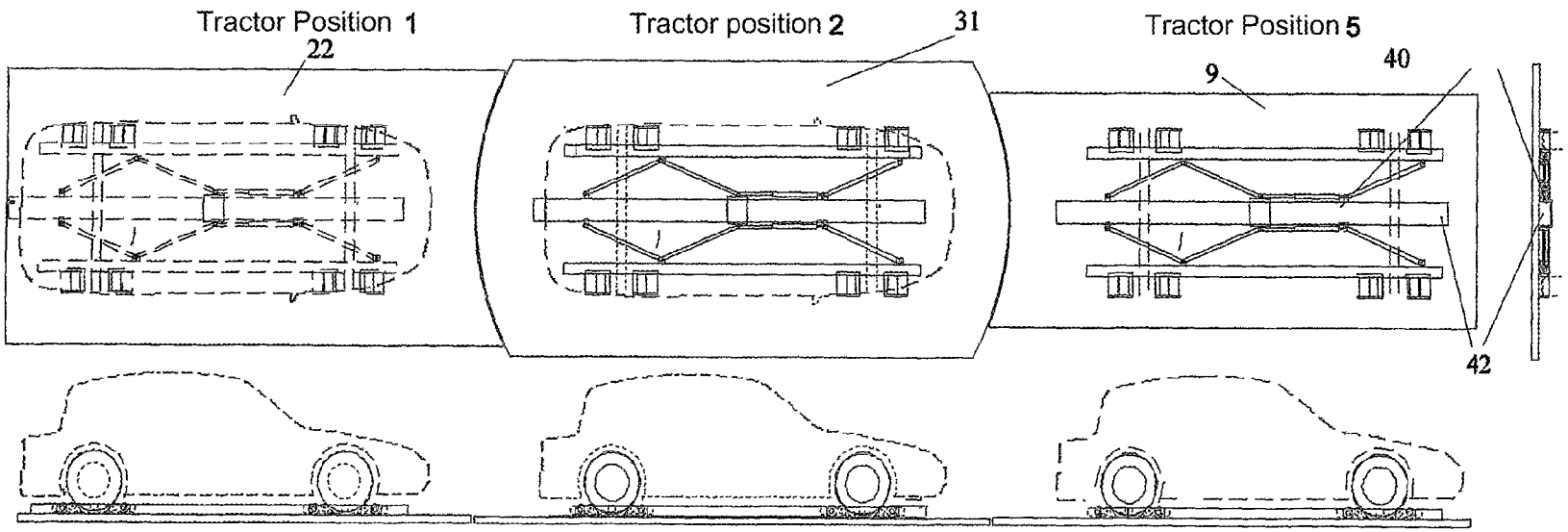
Fig. 4a2

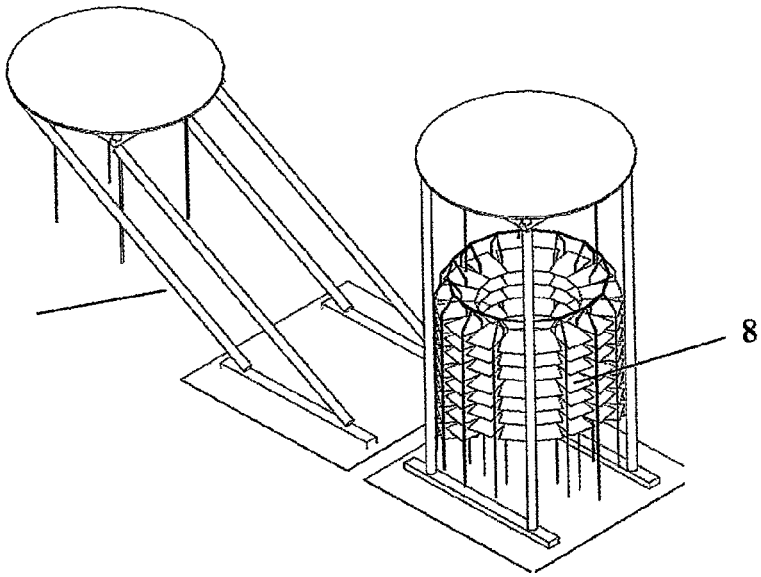
Fig. 9a
Fig. 9b
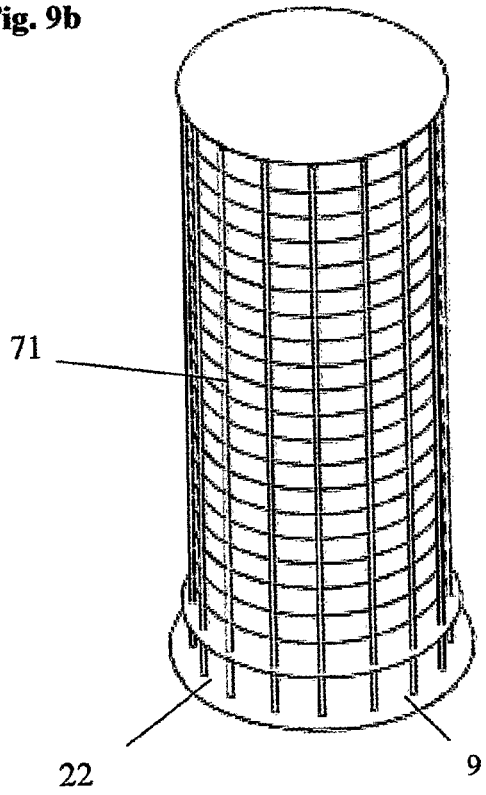
Fig. 9c
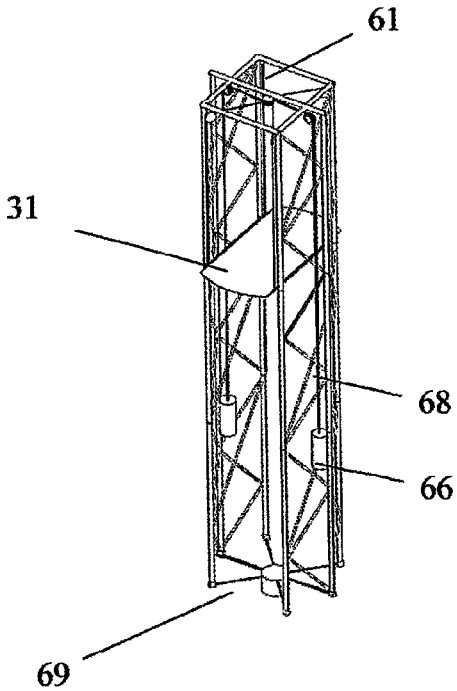

ENTRANCE GATE FOR AN AUTOMATIC PARKING GARAGE HAVING MECHANISM FOR CENTERING A VEHICLE ON THE ENTRANCE GATE

CROSS REFERENCE TO RELATED APPLICATION

This application is a continuation-in-part of application Ser. No. 11/665,106, filed Jun. 18, 2008, which is a national phase of PCT Application No. PCT/CH2005/000599, filed Oct. 12, 2005, which claims priority of Switzerland Application No. 1688/04, filed Oct. 13, 2004. All parent applications are hereby incorporated by reference in their entirety.

FIELD OF THE INVENTION

The present invention relates to an entrance gate and an automatic parking installation having the entrance gate that enables centering a vehicle resting on the entrance gate, and inspection of parking brake of the vehicle. The automatic parking installation further includes a robot enabling lifting the vehicle from the entrance gate and depositing the vehicle to a parking space independent of wheels of the vehicle.

BACKGROUND OF THE INVENTION

The invention concerns a device and a method for centering the private vehicles on a platform, gripping them and transporting them quickly, in order to park them in a space-saving way, and upon request getting them again from the parked position automatically and handing them over to the user.

In combination with a modular design, such that this device can be quickly and easily mounted, dismantled and remounted, this is a less costly alternative for the indoor car parks, parking silos, multi-storeyed car parks and similar systems with a higher utilization of space.

Private vehicles are parked on the road, in parking lots, in garages, multi-storeyed car parks or also in access-controlled automated parking systems. In the typical multi-storeyed car parks, only about 40% of the ground area and around 30% of the enclosed volume can be used for parking the private vehicles. While an average automobile is about 1.7 m wide, 1.6 m high and 4.4. m long, which results in a cubic volume of around 12 $m^3$, the regular multi-storeyed car parks and parking systems include a volume of up to 80 $m^3$ and more per vehicle. In contrast to the earlier models, the modern cars with their compact motors are no longer rectangular in their shape. These taper conically or in oval shape mainly at the front, starting from the rear-view mirror at the side, for which reason a rectangular parking area cannot be used optimally. A lot of valuable space is thus lost in the usual parking systems through entry and exit paths, maneuvering, space for opening doors, stairs, lifts, footway, solid pillars and beams, the minimum floor height for persons, as well as escape routes, illumination and fire-extinguishing systems etc. Parking needs time and skill and is perceived as unpleasant.

In other systems the cars are lifted high with lifting systems, in order to save place, and then these are parked closely by staff (valet parking). This makes parking more expensive and increases the access time.

In the existing parking systems, it is necessary to drive-in the car exactly in a parking slot for parking, where the driver automatically receives instructions for cantering the vehicle on a palette. These palettes, which are needed for displacing the vehicle, show a rectangular area with the minimum length and width of the largest car to be parked, plus tolerances for inaccurate parking and maneuvering. As such, more area is needed than the effective average ground area of the vehicle. Furthermore, before each parking these palettes must be procured or replaced, which needs a complicated mechanism and extensive control and consumes a lot of time and space.

In case of other systems with fixed platforms hanging from vertical chains, which can be seen occasionally in Asia, the enclosed space can be used only poorly and the long access time restricts the actual number of parking spots.

The known systems are designed as fixed structures, which do not permit an economical and quick parking and hence are suitable only for the long-term permanent usage. The long construction time, high investments and the long-term retention have an investment-dampening effect.

SUMMARY OF THE INVENTION

In one embodiment, the present invention is directed to an entrance gate for a parking garage. The entrance gate (110) comprises at least one stationary ground plate (81); two separate trace plates (82,83) beside each other, each adapted to receive thereon a front and rear wheel of a car; the trace plates laid on a top surface of the stationary ground plate, movable in the plane in any direction on the top surface of the ground plate in a gliding manner; a stationary top plate (84) disposed above the two trace plates, the top plate having two elongated cut-out windows (85,86) on opposing sides of a longitudinal centerline of the top plate and each of the two trace plates (82,83) being exposed through one of the cut-out windows; the trace plates movable relative to the top plate and the cut-out windows; and two centering plates (87,88) laid on top of the stationary top plate, disposed on two opposing outer sides of the cut-out windows; the centering plates being connected to two stationary drive units (93,94), the stationary drive units driving synchronous counter-movements of the centering plates; each centering plate movable toward the longitudinal centerline of the top plate, wherein when the centering plates are driven toward each other by the stationary drive units, the centering plates touch outer sides of tires of the car resting on the trace plates and move the car toward a centerline (95) of the entrance gate, until a longitudinal centerline of the car is in alignment with the centerline of the entrance gate.

In the entrance gate, each of the stationary drive units is connected to elongated jackshafts (89,90) extending on both sides of one the stationary drive unit, and the jackshafts move synchronous in counter movements. The centering plates are connected to the two stationary drive units by the jackshafts. The trace plates are connected to a second drive unit (97,98) and are pushable and pullable in a general longitudinal direction of the trace plates by the second drive unit. The second drive unit is equipped with a sensor adapted to determine a resistance force against a counter movement between the trace plates in the longitudinal direction thereof affected by the second drive unit.

In a further embodiment, the present invention is directed to an automatic parking installation, which comprises the entrance gate described above, and a robot (40) adapted to move along the centerline of the entrance gate. The robot comprises four roller forks (45), each having two roller fingers (46) and rollers (57), wherein the robot rolls underneath the car centered along the centerline of the entrance gate, the roll fingers (46) of each fork move together to squeeze on a tire of the car between the roll fingers, thereby lift the car slightly above ground, and the robot moves the car into a lift platform (31) without the tires of the car touching the ground.

In the automatic parking installation, the lift platform includes one or more rails adapted to engage with the robot, and the lift platform is adapted to move vertically within the parking installation to transport the car. The automatic parking installation further comprises multiple decks disposed one above another vertically, and each deck comprising multiple parking platforms (8), and each parking platform has one or more rails adapted to engage with the robot. The multiple decks are arranged in a circular shape with the multiple parking platforms surrounding a central space.

In another embodiment, the present invention is directed to a method of parking a car in an automatic parking installation. The method comprises receiving a car on an entrance gate of the present invention, as received, tires of the car resting on areas of the trace plates exposed through the cut-out windows;

activating the stationary drive units to drive the centering plates toward each other, thereby the centering plates touch outer sides of tires of the car resting on the trace plates, and move the car toward a centerline of the entrance gate until a longitudinal centerline of the car is in alignment with the centerline of the entrance gate; and moving a robot underneath the car along the centerline of the entrance gate, activating four roller forks of the robot to cause roller fingers of each of the forks moving together to squeeze on one tire of the car between the roller fingers, and lifting the car slightly above the trace plates; rolling the robot out from the entrance gate and into a lift platform without the tires of the car touching the ground; moving the lift platform vertically to one level of multiple decks, next to a parking space; and rolling the robot into the parking space, and lowering the car to have the tires resting on the parking space. In the method, the robot lifts the car at least two centimeters above the trace plates.

The method further comprises, prior to centering the car, activating a second drive unit connected to the trace plates to cause a counter movement between the trace plates in a longitudinal direction thereof; measuring a resistance force of the trace plates against the counter movement; and indicating acceptable parking brake if measured resistance force exceeds a predetermined threshold.

The method further comprises retrieving the robot back into the lift platform; and descending the lift platform to the ground. Moreover, the method further comprises rolling the robot out from the lift platform; and repeating the process described above to transport another car received on the entrance gate.

In a further embodiment, the present invention provides automatic parking system for private vehicles for automatic, compact, efficient and economical parking of private vehicles. The automatic parking system includes several columns, rails or pillars (2), on which circular disc-shaped parking platforms (8) with parking ramps (22) rest in several levels one above the other for parking the private vehicles, where a lift shaft (61) stands or hangs in the middle of this parking platform (8) and delivery ramps are arranged on one or more drive-in and drive-out levels. The automatic parking system characterized by the fact that this lift shaft (62) has a lift (61) with a fixed or back and forth movable lifting platform (31), on which a mechanical cantering, lifting and pushing system (tractor) (40) is arranged, with which a vehicle on the parking ramp or parking platform can be gripped at its wheels, cantered, lifted and moved forward or backward on to different ramps and platforms, where the lift shaft (61) with its lift and the cantering, lifting and pushing system (40) can be controlled by a central computing unit for a quick and optimum space-saving arrangement of the cars to be parked on the respectively free parking platforms (8) or exit ramps (9).

The automatic parking system is further characterized by the fact that the parking ramps (22) are equipped with a cantering device, such that a automobile can be cantered laterally irrespective of its track width on the shortest possible distance, comprising of guide rails (21) equipped with rollers (25) for avoiding overriding, which are fixed at the parking ramp (22) via swivel arms (37), push rods (28) and cantering rails (29) movable in such a way that the guide rails (21) can be moved only laterally and symmetrically running in the opposite direction and are positioned on the front converging conically by means of springs (23), so that when a vehicle is driven-in its front wheels (16) open these guide rails on the front and these then close in the rear part and in this way the vehicle can be moved laterally in the center with the wheels travelling on longitudinally-aligned rollers (25), pressing outside on the wheels.

The automatic parking system is also characterized by the fact that the computer-assisted lift shaft (62) that rotates on the vertical axis (62) contains a lift (61) in the shape of a high-speed lift with lifting platform (31), on which a computer-assisted, mechanical cantering, lifting and pushing system (tractor) (40) is placed, with the help of which a vehicle can be gripped and rolled from the parking ramp (22) on to the lifting platform (31), then this lifting platform with the lift can be lifted on to the deck assigned by the central computer and the entire lift shaft (62) with the lift can be rotated to the calculated position, there the vehicle can be pushed on to the parking platform (8) and this can be removed again, in the reverse sequence, from the parking platform on to the lifting platform (31) and can be pushed on to an exit ramp (9) assigned by the central computer in the other direction from the lifting platform in the forward travel direction of the vehicle.

Moreover, the automatic parking system is characterized by the fact that the mechanical cantering, lifting and pushing system includes a robot (tractor) (40), which is led on a rail and can travel under the vehicle, with which the vehicles can be precisely cantered laterally, lifted and also moved in two directions and laterally cantered, if parallel and symmetrically designed longitudinal beams (forked rails) (44) are available, with the help of which a vehicle, pushed inside on its wheels, can be moved laterally in the middle of the parking ramp (22) and the steering wheels can be aligned, and with the help of two fingers travelling below the wheels (51) all the four wheels can be lifted and vehicle can be moved back and forth from the lifting platform (31) on to the assigned platform or ramp on the underlying rollers held exactly in the middle of the calculated position.

The automatic parking system is further characterized by the fact that the robot (tractor) (40) is equipped with four roller forks each having a pair of roller fingers (46), with which the wheels of a car can be gripped, aligned, lifted and the car can thus be pushed rolling on the rollers (57), when the roller finger (46) placed in a movable way on a rail (forked rail 44) can be moved below the vehicle first laterally from inside, before and after the vehicle wheels, and then against each other from the front and the back, such that the wheels can be lifted with two additional rollers, the rollers (57) with overlaid segments of a roller or caps laid on the roller axis (58) and hence the private vehicles can be moved irrespective of the wheel dimension, track width and axis distance, gripped quickly mechanically and the weight distributed on its rollers (57).

Furthermore, the automatic parking system is characterized by the fact that these platforms with same or different lengths (8) each have a one-sided conically converging shape and are arranged at an angle of about 20 degrees (about 16 places in each deck) in a star shape on a circular disc having a round or polygonal exterior shape and that with the central computing unit for a quick and optimum space-saving arrangement the vehicles to be parked can be assigned to an optimum place by taking into consideration the conical and oval shapes of the front sections of the private vehicles with corresponding dimensioning and computer-assisted, specific allocation, such that broad and narrow vehicles are placed side by side in such a way that each platform must have only the width for the average and not for the biggest vehicle size, where the rectangular parking areas overlap with the front edges (FIG. 8), as such platforms with conical basic shapes can be used and through this combination and the corresponding allocation the vehicles can be parked compactly to the maximum possible extent and with the vertical pillars (73) and with the rotating lift shaft (62) even the lift guide rails (65) are present in the non-usable space.

The automatic parking system is further characterized by that, as a variant, two parallel lifts (61) or lifting systems are placed in the lift shaft (62) which rotates on the vertical axis. Further, as a variant, the lifting platform (31) is equipped each with two parallel tractor rails (42) with two parallel working tractors (40). Moreover, in case of parallel working tractors (40) always two parking platforms (8) lying adjacent to each other are aligned in parallel.

Also, in the automatic parking system, as a variant, a tractor (40) is placed at the lower side of the lifting platform and in case of a failure of the upper tractor the lifting platform can be rotated by 180 degrees along its transversal axis and in this way the lower tractor can be used.

Yet, the automatic parking system is characterized by the fact that the forked rails (44) is cantered while extending and cantering the vehicle by applying pressure on the steering wheel of the car which is possibly not aligned in the direction of travel and simultaneously with the steering deflection of the same.

Moreover, the automatic parking system is characterized by the fact that with one and the same device, namely the robot, known as tractor (40) (Car Handling Robot), the vehicles can be centered, gripped, lifted, driven, their steering angle can be cantered and these can be moved quickly on both the sides, via the lifting platforms, horizontally on to the ramps (9, 22) or on the platforms (8, 31).

In addition, the automatic parking system is characterized by the fact that the robot or the tractor (40) can automatically grip, center, lift and move all the common vehicles irrespective of their dimensions, track width, axis distance and wheel diameter, without having to measure these values first by placing the roller forks (45) and the roller fingers (46) in the forked rails (44) in their longitudinal direction and through their dimensions and design by taking a position before gripping the vehicle, which lies outside or within the smallest or the largest axis distance, track width, or wheel position.

Yet further, the automatic parking system is characterized by the fact that with the same device, namely the robot or the tractor (40), in three work steps, namely the driving of the forked rails (44), the bringing together of the roller finger (46) and moving the tractor (40) backward or forward, the vehicle can be cantered, the deflection of the steering wheel can be set to neutral and the car can be lifted, driven and moved on both the sides over the lifting platform.

The system is also characterized by that all delivery ramps at the drive-in or drive-out level can be used, depending upon the requirement, for driving in as well as for driving out, i.e. as parking ramp (22) as well as also exit ramp (9).

Furthermore, the automatic parking system is characterized by that the robot or the tractor (40) runs on a rail (42) fixed on a lifting platform (31) and can be driven out with the help of a telescopic-shaped expandable guide on both the sides and hence neither a channel, a guide slot nor other devices are necessary for guiding a car on to a parking platform.

Moreover, in the automatic parking system the parking platforms in different lengths are placed in such a way that their outer shape of the circular disc levels form a polygon, where in case of a square or hexagon or octagon of several systems arranged side by side without gaps the ground can be utilized better and so through a specific assignment of the vehicles on the basis of their length a higher utilization of area results for the parking spaces having different lengths.

Additionally, the automatic parking system is characterized by the fact that with a control computer and on the basis of the determined dimensions of the vehicle, of the order and of the saved data, such as the dimensions of the vehicle and the parking space, occupied parking spaces, statistical values and vehicle position etc, the allocated position, the necessary angle of rotation of the lift shaft, the vertical position, the necessary direction of travel and the travel distance of the tractor, etc. can be calculated for the best positioning of the vehicles.

Further, in the automatic parking system data is provided to the central computing unit by electronic sensors, which measure the height, length and the front width of the car based on the layout angle of the circularly placed parking spaces (chord of the distance of the parked car to the center of the circle) and transfer these to the computer for calculating the optimum space with minimum length, width, and height.

In addition, the system can be designed over the ground as a tower or also below the ground in a shaft as a standing or hanging structure in modular design and as such can be dismantled and reused with minimum effort.

The advantages of the present invention will become apparent from the following description taken in conjunction with the accompanying drawings showing exemplary embodiments of the invention.

BRIEF DESCRIPTION OF THE DRAWINGS

FIG. 4*a*1 shows the tractor with roller forks operating principle.

FIG. 4*a*2 shows tractor positions with fixed lifting platform.

FIGS. 9*a*, 9*b* and 9*c* illustrate erection method and overview of design.

It is noted that in the drawings like numerals refer to like components.

DETAIL DESCRIPTION OF THE INVENTION

Figure 1A:
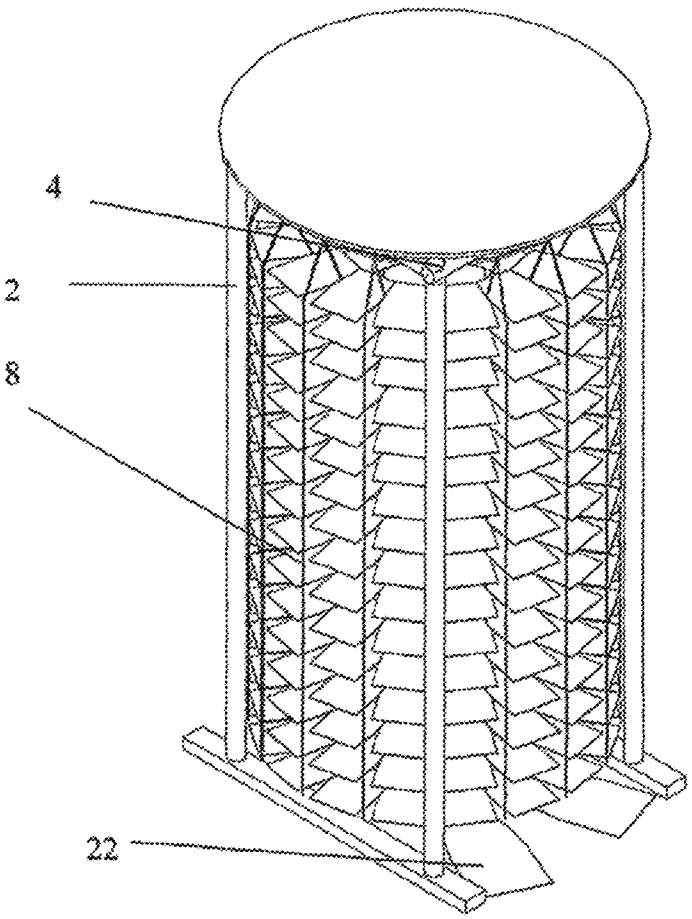
FIG. 1*a* shows a complete overview of the parking system.

In one aspect, the tasks of the invention are to devise a simple technical device and an automated method to park the private vehicles quickly and economically with minimum space requirement and to retrieve them quickly for the users upon their request.

In order that the vehicles can be parked as closely and precisely as possible, taking the car in and out of the storage should be done automatically. To do this, the modern shapes and the different sizes of the cars should be taken into account for an optimum parking. To keep the usage costs below the current level, the device should be manageable with fewer persons or even without an operator, and it should have low maintenance, minimum susceptibility to faults and high reliability. In order to make the device suitable for temporarily available parcels of lands and gaps between buildings, and for temporary solutions, it should be devised in a simple modular design with little effort, which can be remounted quickly, if needed.

In order that the vehicles can be gripped mechanically, displaced and parked precisely, these must first be positioned correctly. To do this precisely and without errors, it cannot be left to the customers. Placing the vehicle must be simple. Even when the vehicle is not placed correctly, the system must fulfil its task. The first sub-task is thus to center the vehicle automatically by mechanical means and to bring it in a uniform, precise position for the mechanical and electronic collection.

The vehicles should be moved and stored automatically through a simple technique without any means of transportation. The second sub-task is to grip the vehicles accurately and quickly by means of a method, so as to move it to the assigned position and to pull it out of this again. For this, the components must be designed in such a way that these can grip the vehicle at an appropriate point, suitable for all vehicle types, in order to place it on the platform of the lift and on the parking ramp, and finally pull the vehicle out of there again and place it on the exit ramp to be handed back to the user, when needed.

The third sub-task is to park the vehicles as closely as possible with a smart arrangement, with the least wastage of space and simple construction. The modern basic shapes and the different widths, heights, and lengths of the cars should be used optimally. By means of selected arrangement, the method, the electronic measurement and the IT-supported allocation of the parking positions, wasted empty spaces are avoided to a large extent and the degree of space utilisation is increased manifold as compared to the conventional systems.

The fourth sub-task is to handover the vehicles back to the driver quickly, safely upon request, using a simple and safe design in the direction of traffic, so that the handover is simple and swift.

The fifth sub-task is to design the entire system in such a way that this can be erected, dismantled, moved and re-erected with minimal effort, without using cranes, supports and heavy foundations. For this, the components are to be assembled in such a way that they can be reused.

Figure 1:
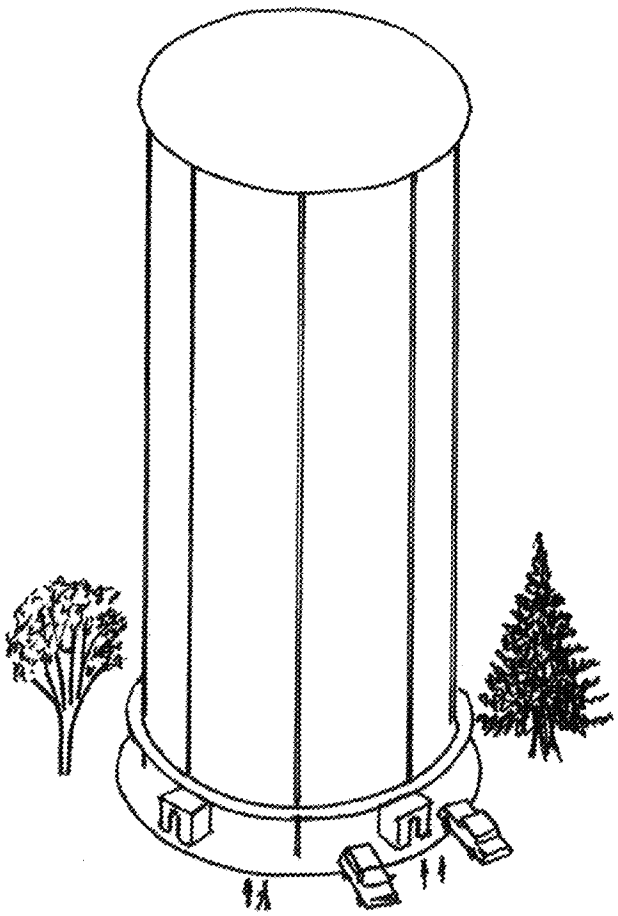
FIG. 1 shows an illustrative view of the automatic parking system of the present invention.
Figure 1B:
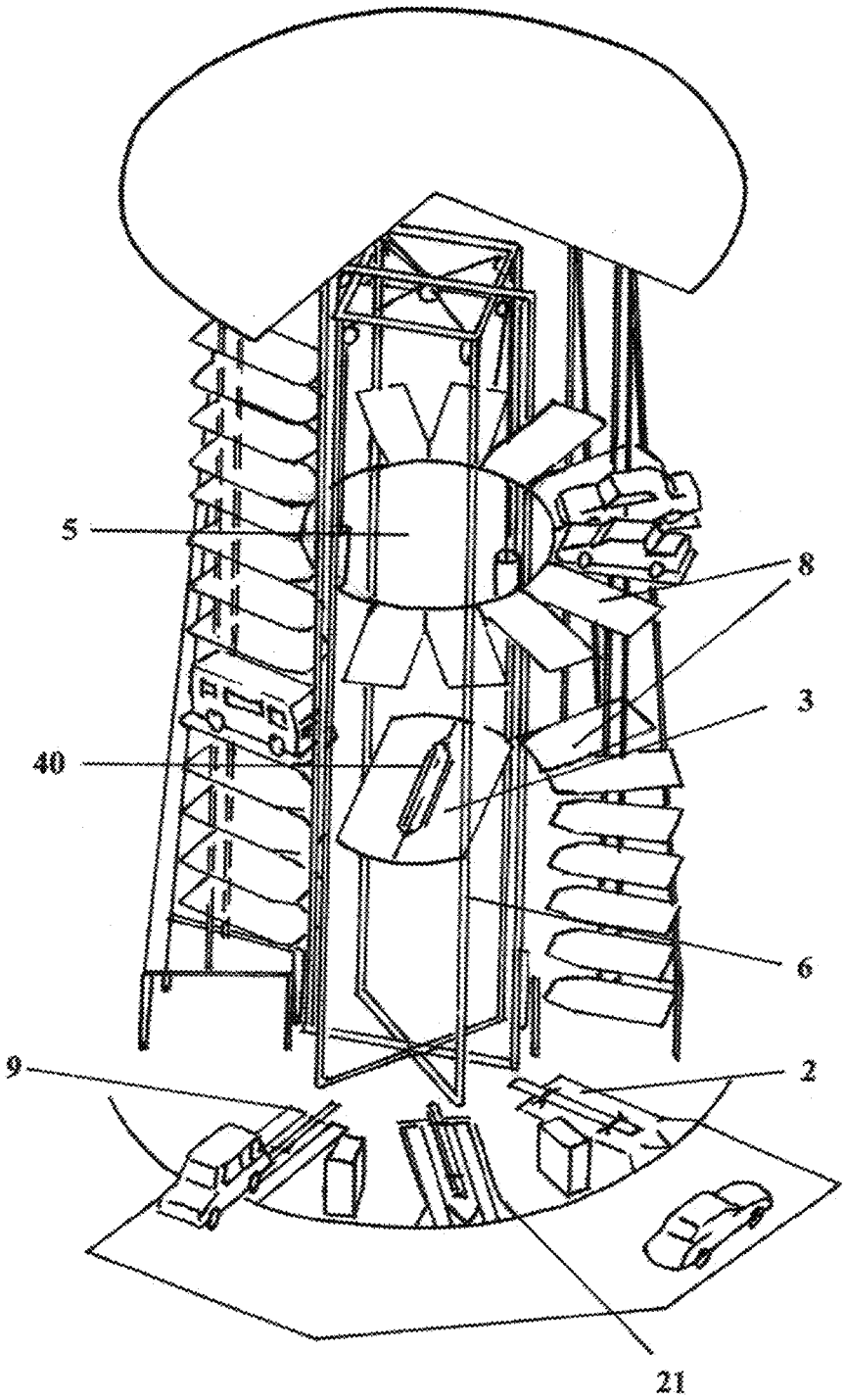
FIG. 1*b* is a 3D sectional representation of the parking system.

Referring to FIG. 1, the solutions are accordingly represented by a device, which parks the vehicles fully automatically and quickly in a space-saving way by a special arrangement, takes them out and returns them when demanded. Furthermore, the vehicles are first centered on a parking ramp by means of guide rails and rollers, then gripped at their wheels with the help of a device, brought in the starting position and then moved automatically and precisely without making use of the means of transportation, such as palettes or conveyor belts. This is done by pushing small rollers below the wheels of the vehicle, in order to place the vehicle on these and to move it. With the help of a device—hereinafter referred to as the tractor—on a platform, which is mounted at a central lift, the vehicles can be moved horizontally. On the lifting platform these can then be rotated on the vertical axis and at the same time quickly transported vertically. The complete system is assembled in a modular design with screws and bolts in such a way that it can be dismantled easily when required and then reassembled on another location without making use of any expensive construction machines. The combination of the following individual inventions results in the desired solution with the advantages mentioned above vis-a-vis the existing systems.

Parking Ramp, Cantering and Positioning

Figure 2:
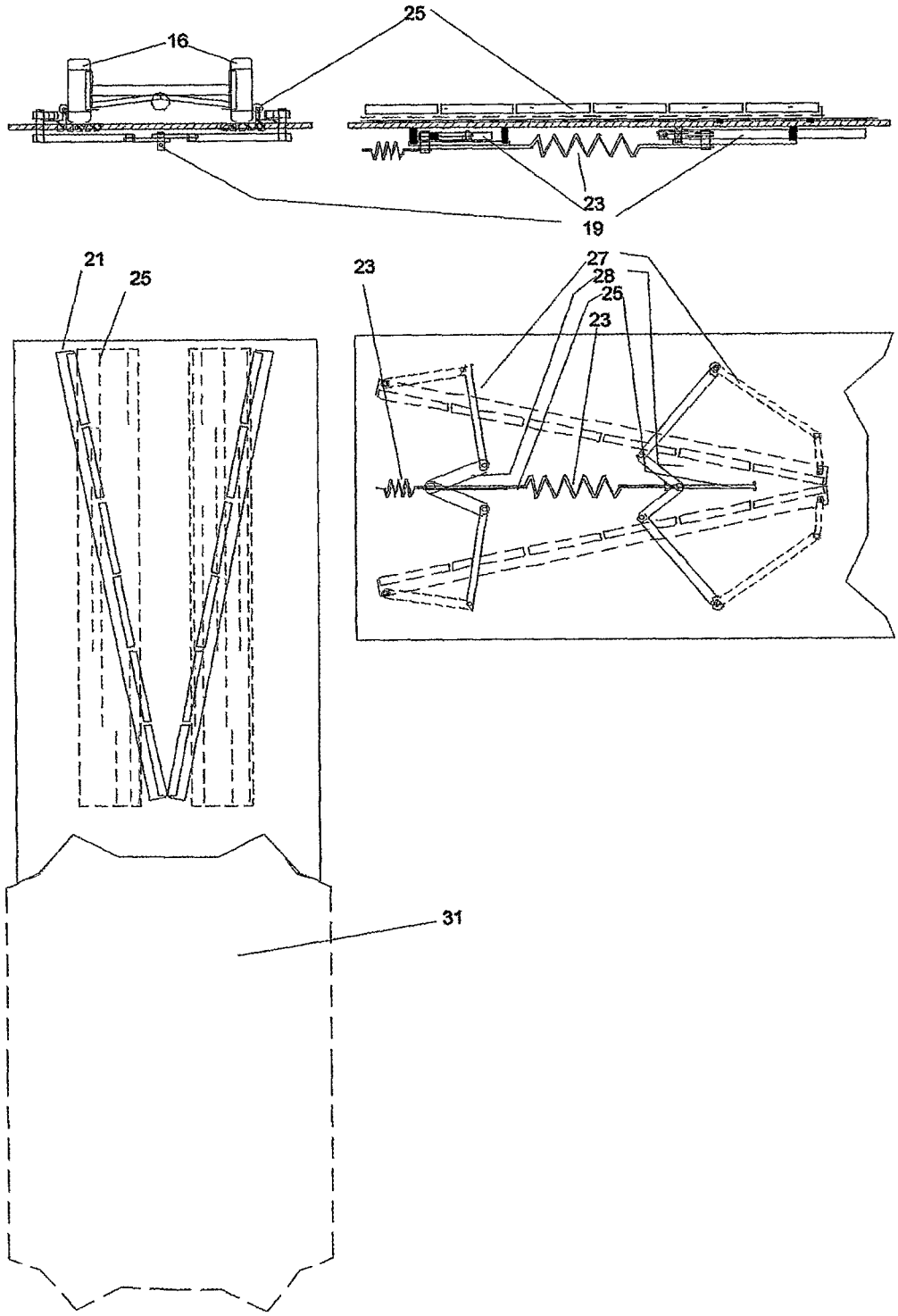
FIG. 2 shows the details of parking ramp and centering system.
Figure 2A:
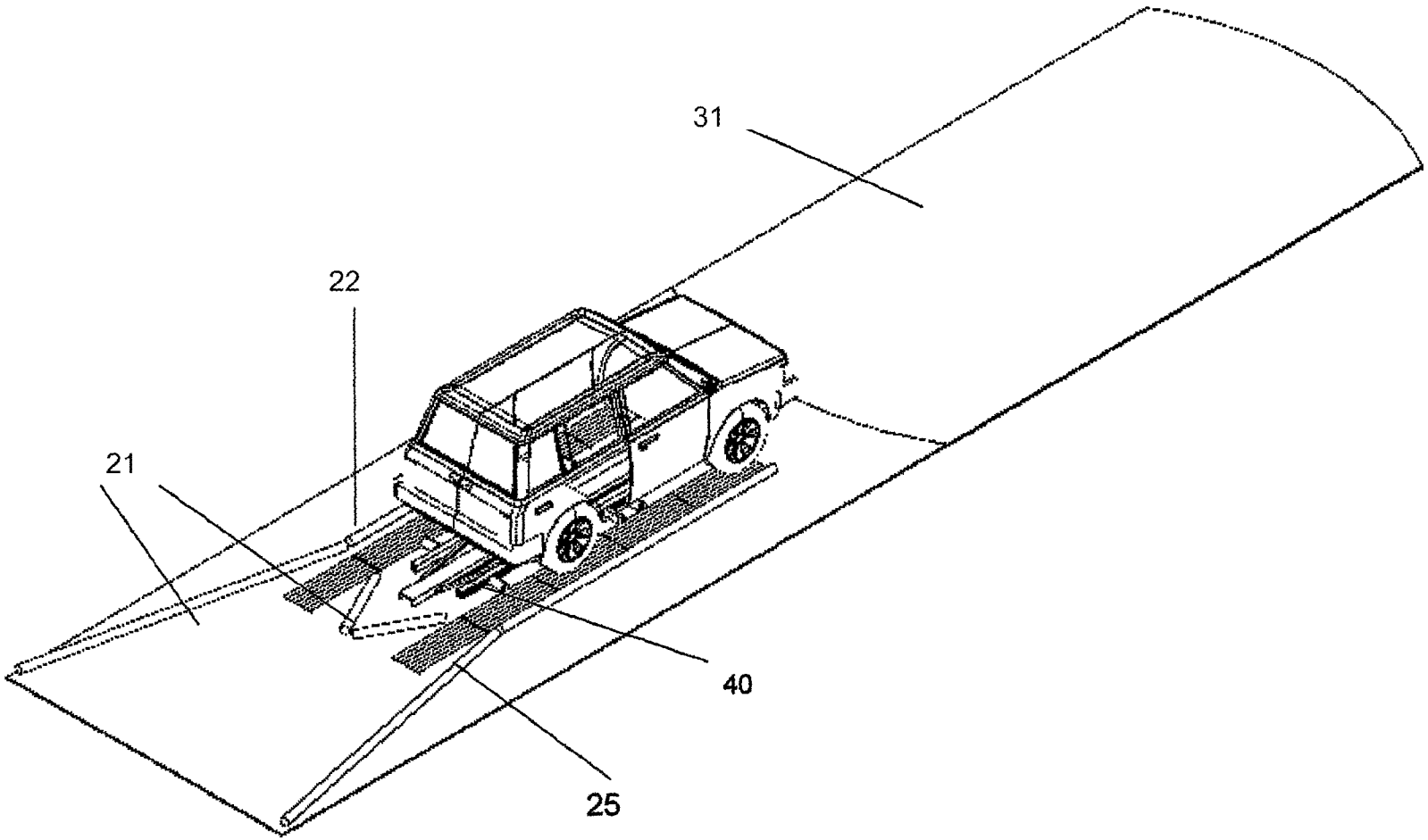
FIG. 2*a* shows the parking ramp and cantering system with fixed guide rails.

Referring to FIGS. 2 and 2*a*, in this solution, the vehicles are cantered automatically and exactly on a parking ramp by driving it on longitudinally aligned rollers (25) on the parking ramp and moving it with side guide rails (21) while driving in the vehicle at the wheels (16) in the middle of the parking ramp (FIG. 2). Rollers on the guide rails prevent the vehicle from over-rolling. Each of these two guide rails is joined mechanically to each other on the front and at the back with two swivel arms (37) and cantering rails (29) and are pressed in the middle by means of a central tension spring (23). However, since the rear arms are pressed away from one another by means of another tension spring (23), the guide rails at the back go to the state of rest in the open position. If the guide rails are pressed away from each other by the front wheels when the vehicle is driven in, then the closing force on the rear arms is increased via the central spring (23) and the guide rails also close at the back. As a result of this, the vehicle can be moved in the center now only at the back. When the vehicle leaves the parking ramp, the guiding rails go back to their original resting position, conically closed at the front and open at the back. In this way, it becomes ready for driving in the next vehicle. This arrangement does not need any mechanical drive and is maintenance-free to a large extent.

The proper positioning of the vehicle is achieved by instructing the driver to drive till an electronic and mechanical stopper, upon which a stop signal is given to him. The vehicle is now gripped mechanically, measured electronically and a computer determines a suitable parking space for the vehicle. If none is available, the driver—as in the case of a car washer—is instructed to put the steering wheel in neutral, to apply the brakes, to shift the gear to 1 or P, to leave the vehicle and to close the doors. Once this leaving has been registered electronically, any further access is barred with the help of a gate for security. As such, the vehicle is now ready to be parked and the parking ticket can be issued to the driver. To avoid delays, several such parking ramps (FIGS. 2 and 2*a*) can be placed before one or several unloading zones.

As an alternative, fixed guide rails or rails with mechanical drive can also be used for cantering the vehicle. In the variant of a fixed guide rail, the car is held only within a specific limit of the lateral deviations. These guide rails are then aligned for the widest vehicle. The exact cantering is then done by the arms (forked rails) (44) of the tractor (FIG. 4*a*, FIG. 4*b*), which hit upon the wheels synchronously from inside and thus displace the vehicle to the side and center it (Z4*a*1, 42, 37) 2 Tractor (FIG. 4*a*, FIG. 4*b*) horizontal displacement Tractor, Horizontal Displacement Referring to FIGS. 4*a*, 4*b* and other figures, in order to manage without palettes or conveyor belts, all vehicles must be gripped at a uniform point, suitable for all models. This is done with the help of a device, the tractor (40) (FIG. 4*a*), which centers the vehicle, grips it at the wheels, lifts it and moves it. The tractor is fixed on the lifting platform and comprises of hydraulically movable tractor rails (tractor rails) (42), at which a parallel swivellable forked rail (forked rail) (44) is fixed on both the sides. Each of these are equipped with two forks (45) each having two fingers with rollers (51) (roller fingers). Each of the roller fingers comprises of one to two rollers (57) and one lifting roller (58). Both the roller fingers of each fork are connected with each other by means of an actuator (pneumatic or hydraulic cylinder) (48) and can run freely together in the forked rail, but are held in the starting position by means of a spring or else the front-most roller finger can be designed as fixed.

The forked rail is connected with the tractor rail via two rods (41) and a slider (43) mounted on the tractor rail with pneumatic or hydraulic actuators. This tractor rail can move over the lifting platform beyond it (31) (FIG. 4*a*), when is moved in the corresponding direction by two telescopic cylinders or an electro-mechanical drive. The forked rail is pressed by the tractor rail against the wheels, as a result of which the vehicle is moved exactly in the middle and is stable. Subsequently the two roller fingers of each fork are moved together, through which the wheels are lifted on to the lifting rollers (58). When the fingers are closed, these are fixed with the forked rail, in order to transfer the lateral movement to the vehicle. This brings the vehicle in a uniform and precise initial position and can now be measured electronically, so that the computer can determine the optimum parking space.

Figure 4A:
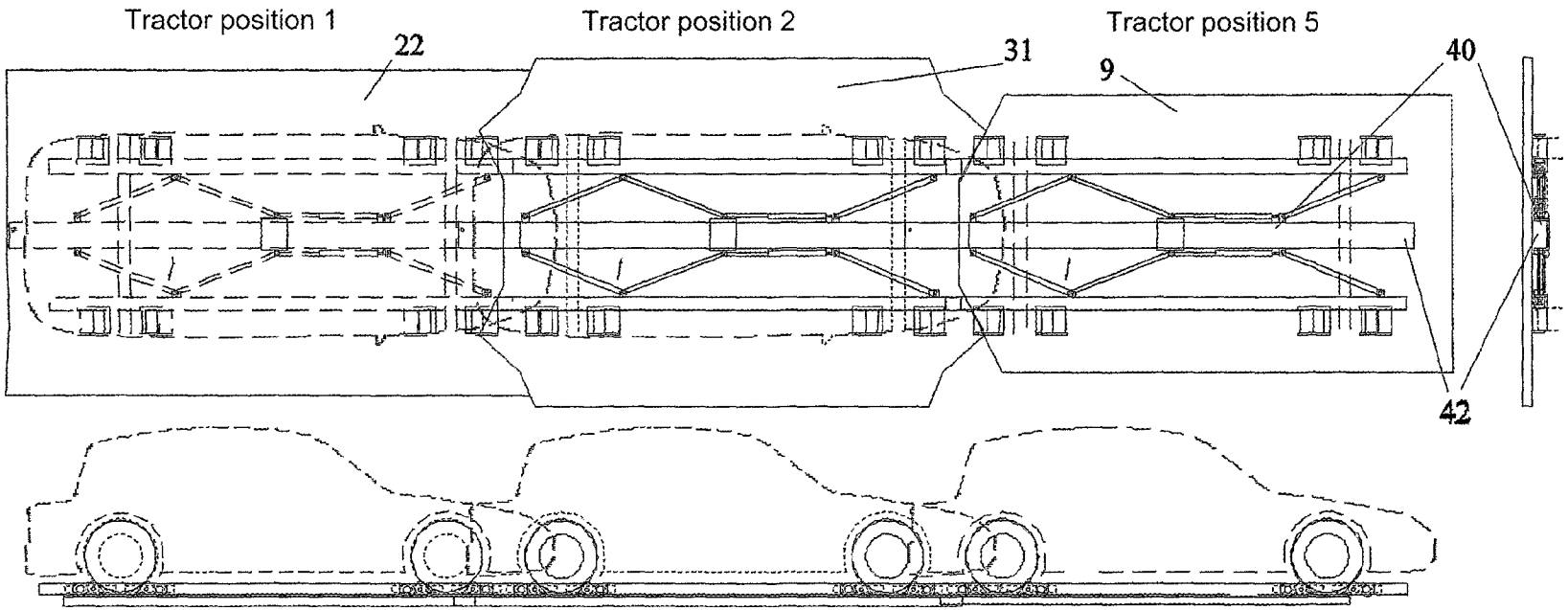
FIG. 4*a* shows tractor positions with movable lifting platform.

Next the vehicle—rolling on the roller fingers—is pulled on to the lifting platform (FIG. 4*a* Tractor position 1). The lifting platform (31)—unless designed to be mobile—now moves to the middle of the lift (61) and then travels vertically to the assigned deck (Tractor position 2). After the lift has rotated to the calculated parking platform—in the reverse process—the tractor discharges the vehicle again (Tractor position 1). The roller fingers then travel away from each other and the forked rails then contract. Thereafter, the tractor retreats back to the lifting platform and is ready for the next vehicle. For discharging the vehicles on the exit platform (9) the lifting platform and the tractor travel in the opposite directions (Tractor position 3), which facilitates the parking in the direction of the traffic.

Roller Finger, Grip and Lift

Figure 4B:
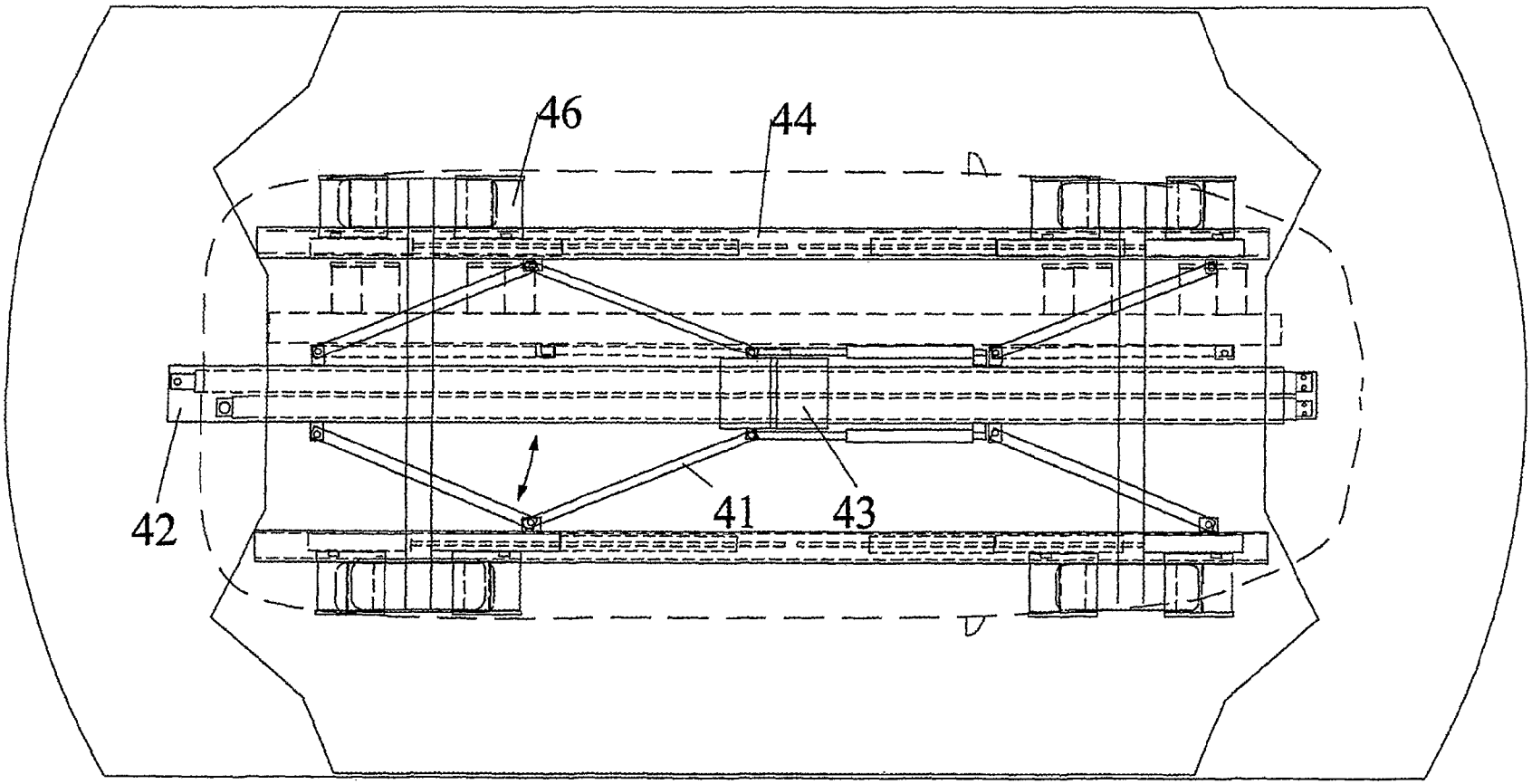
FIG. 4*b* shows tractor on the lifting platform (fixed and moving).
Figure 4C:
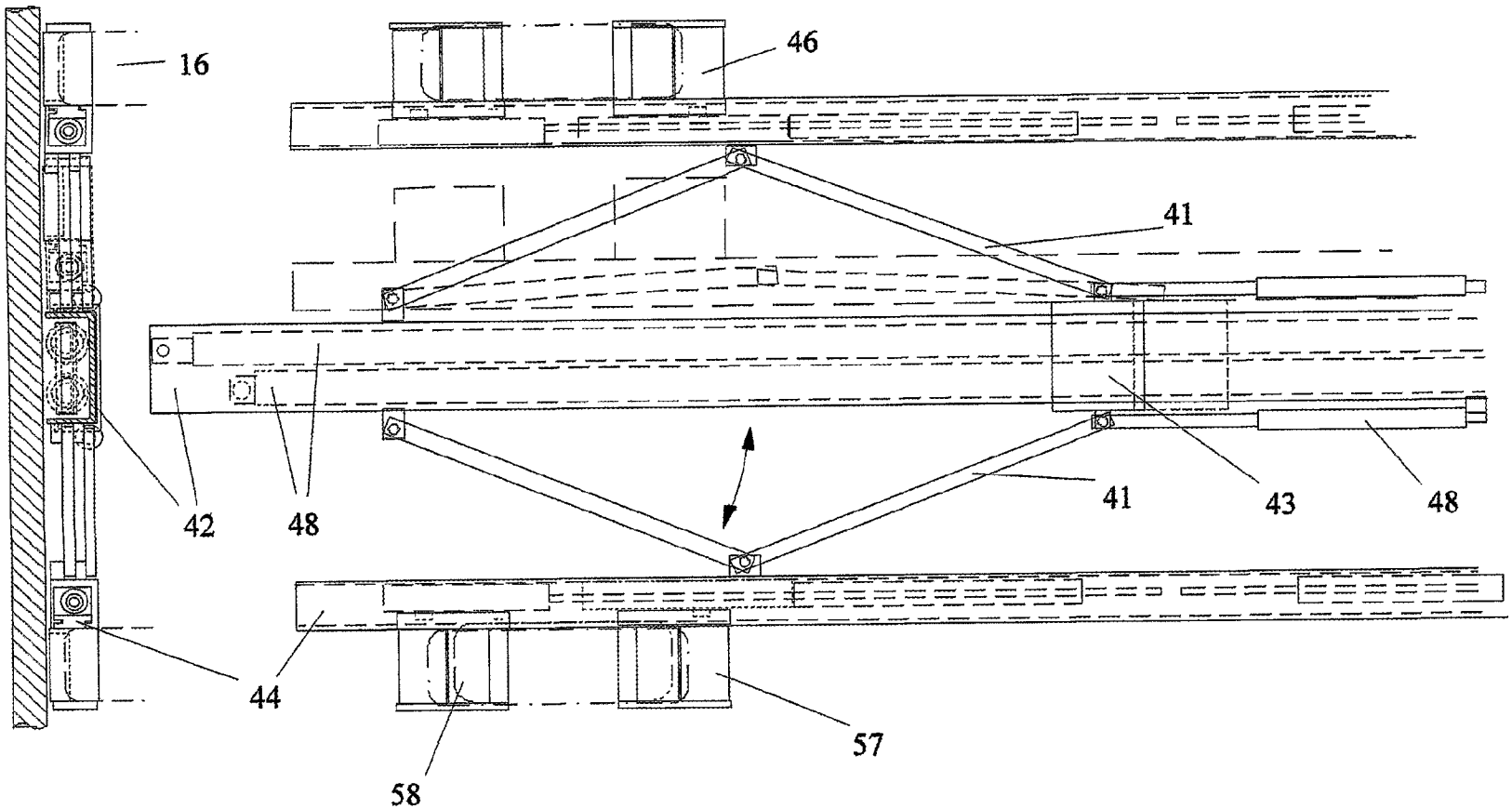
FIG. 4*c* shows tractor with roller forks.
Figure 5A:
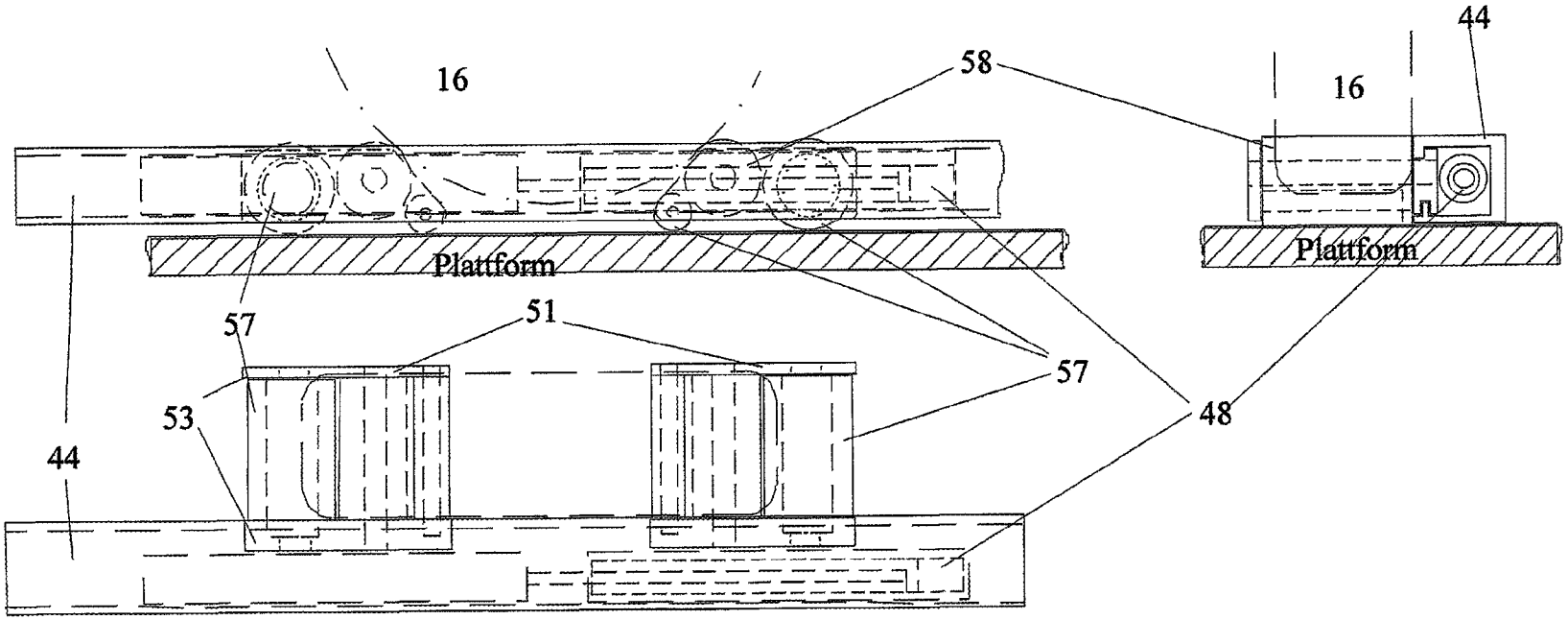
FIG. 5*a* shows roller forks with two rollers.
Figure 5B:
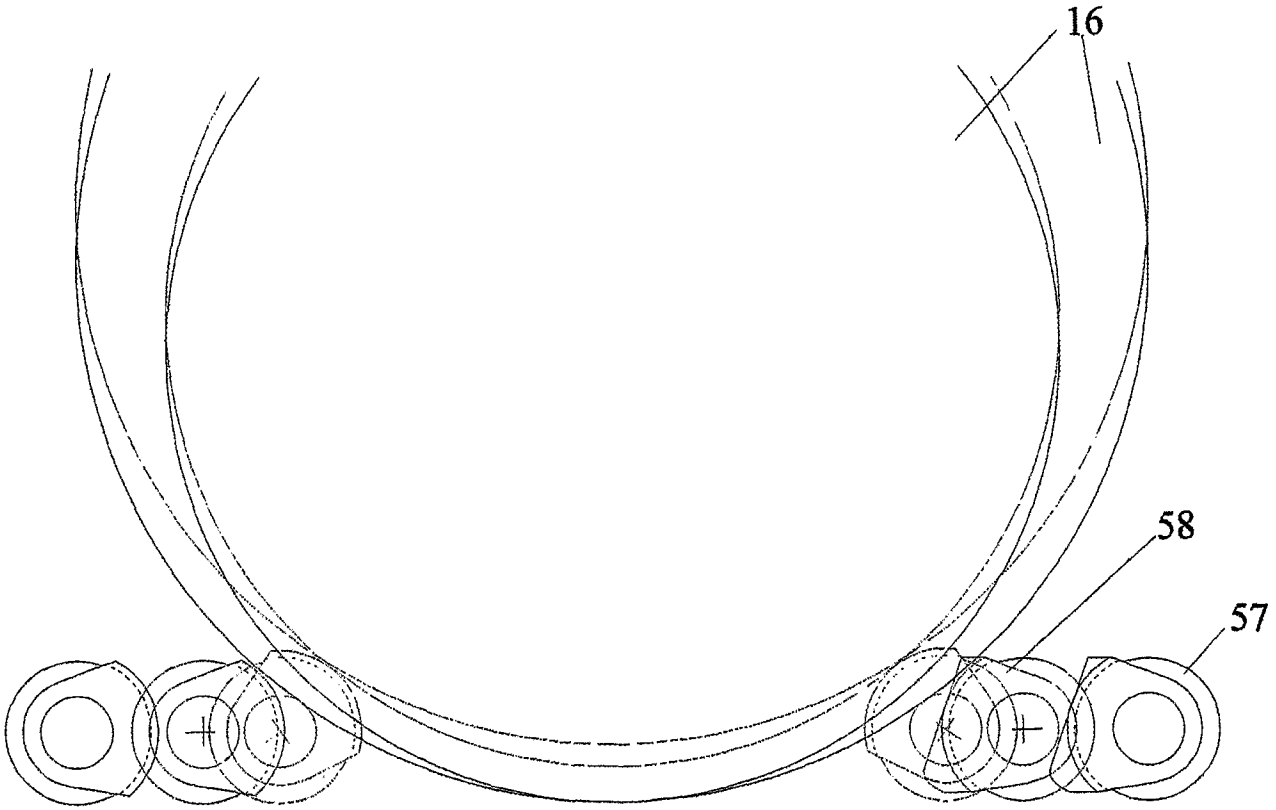
FIG. 5*b* shows roller forks with 1 roller and overlaid lifting roller

Referring to FIG. 5, FIG. 4*b*, FIG. 4*c*, the transfer of the tensile and impact forces from the tractor (40) to the wheels and the lifting of the vehicle is resolved by the mentioned roller fingers (51). These comprise of one to two rollers (57), which carry a lifting roller (58). The rollers roll on the corresponding platform. The lifting rollers (58) serve for lifting and carrying the wheel. The lifting rollers are designed either as separate rollers or concentric on the same axis as the rollers, where these then have the form of a segment of a barrel and overlay the rollers. (Z5*a*, 58). In this way the contact surface of the wheels can be enlarged in small increments. The axes of the rollers have a flange (53) on both the sides. The inner flange runs in the forked rail (44), where the drive cylinder (48) is present that contracts the roller fingers. In the open position these roller fingers are held in a certain starting position by means of springs. In the closed position the fingers are mechanically anchored with the rails, in order to transfer the compression and the tensile forces of the tractor to the vehicle. The front-most roller can also be anchored fixed and hence this additional anchoring can be omitted.

Lift and Lifting Platform, Transporting and Rotating

Figure 3:
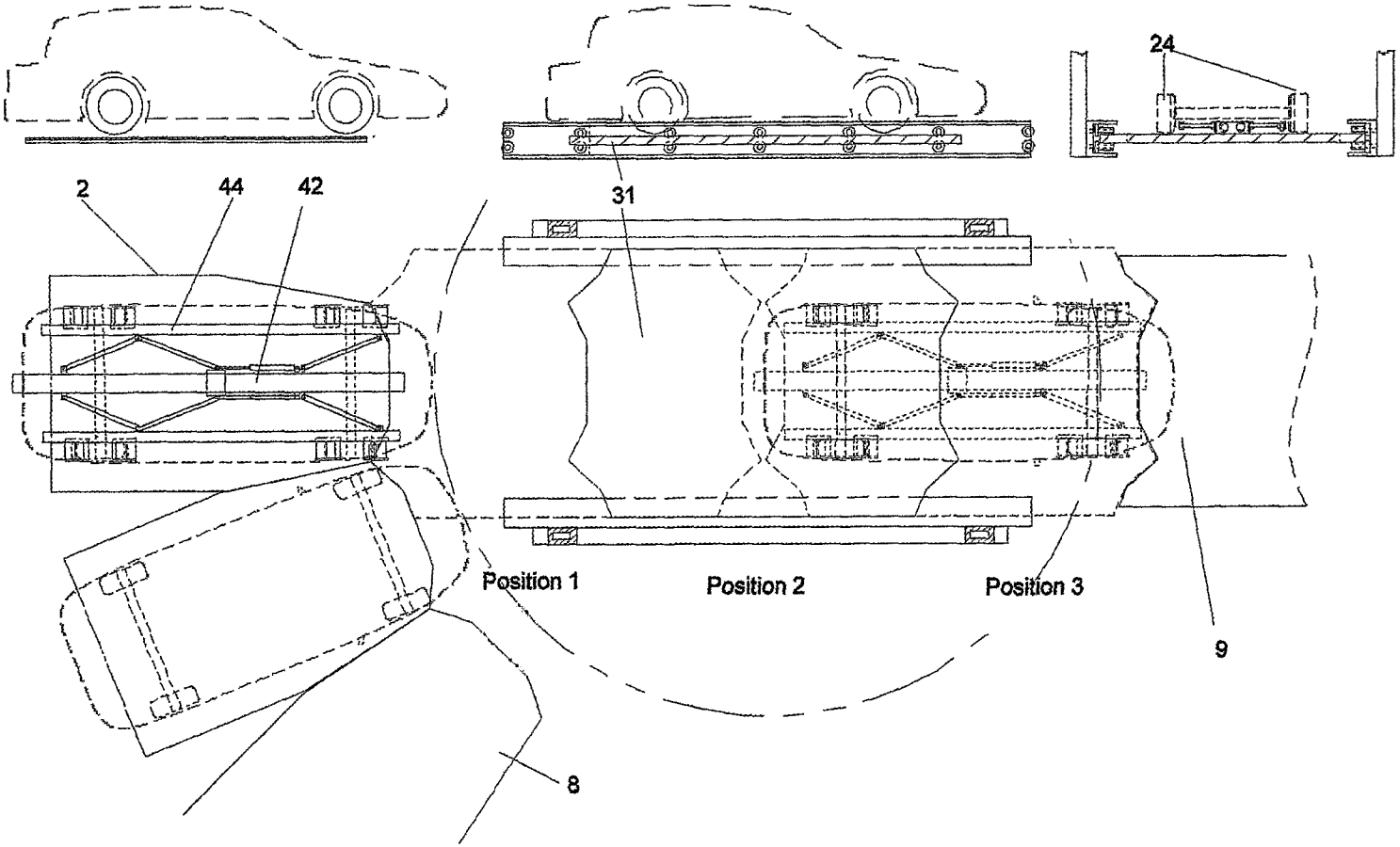
FIG. 3 shows the lifting platform with tractor.
Figure 6A:
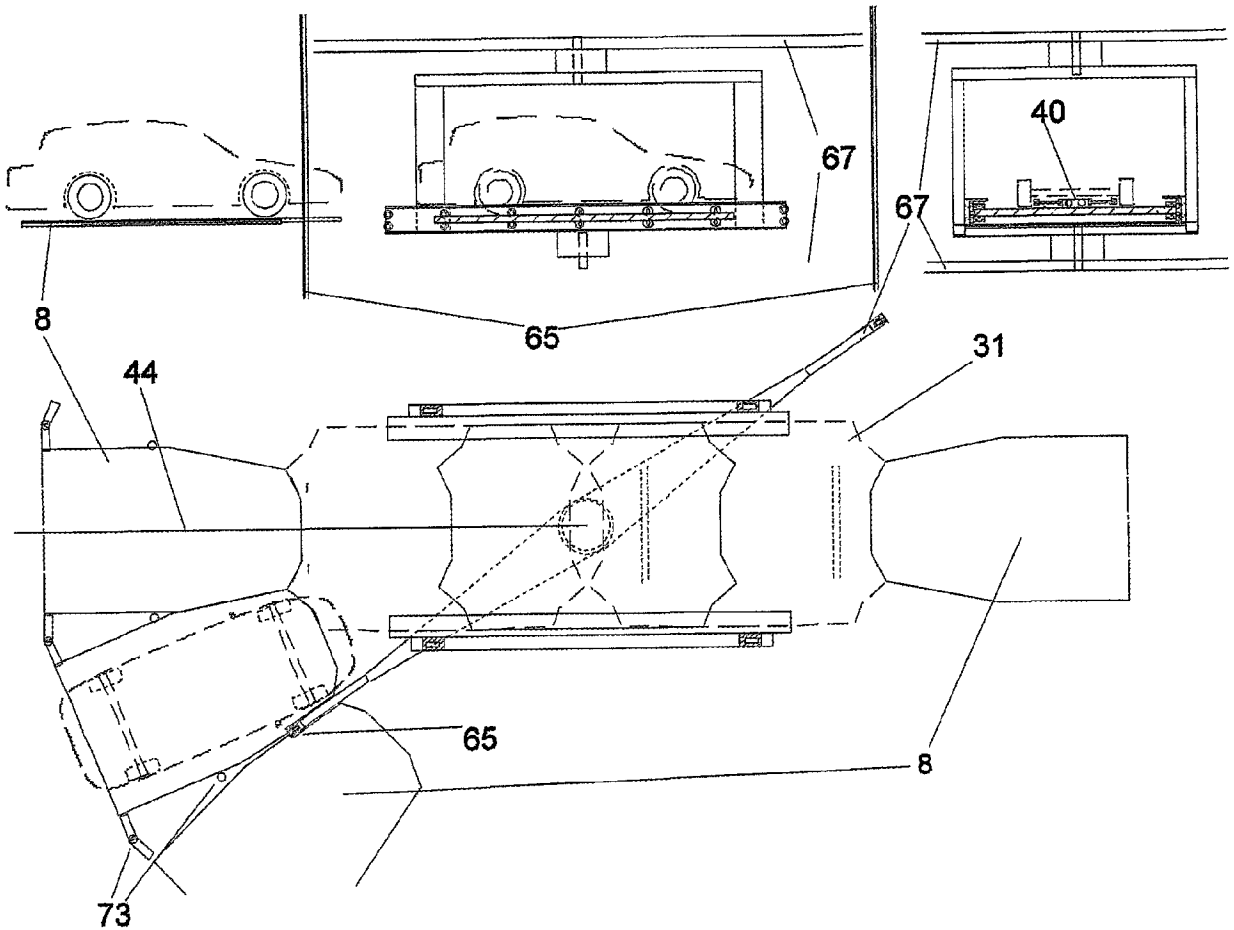
FIG. 6*a* shows the lift with fixed lift shaft.
Figure 6B:
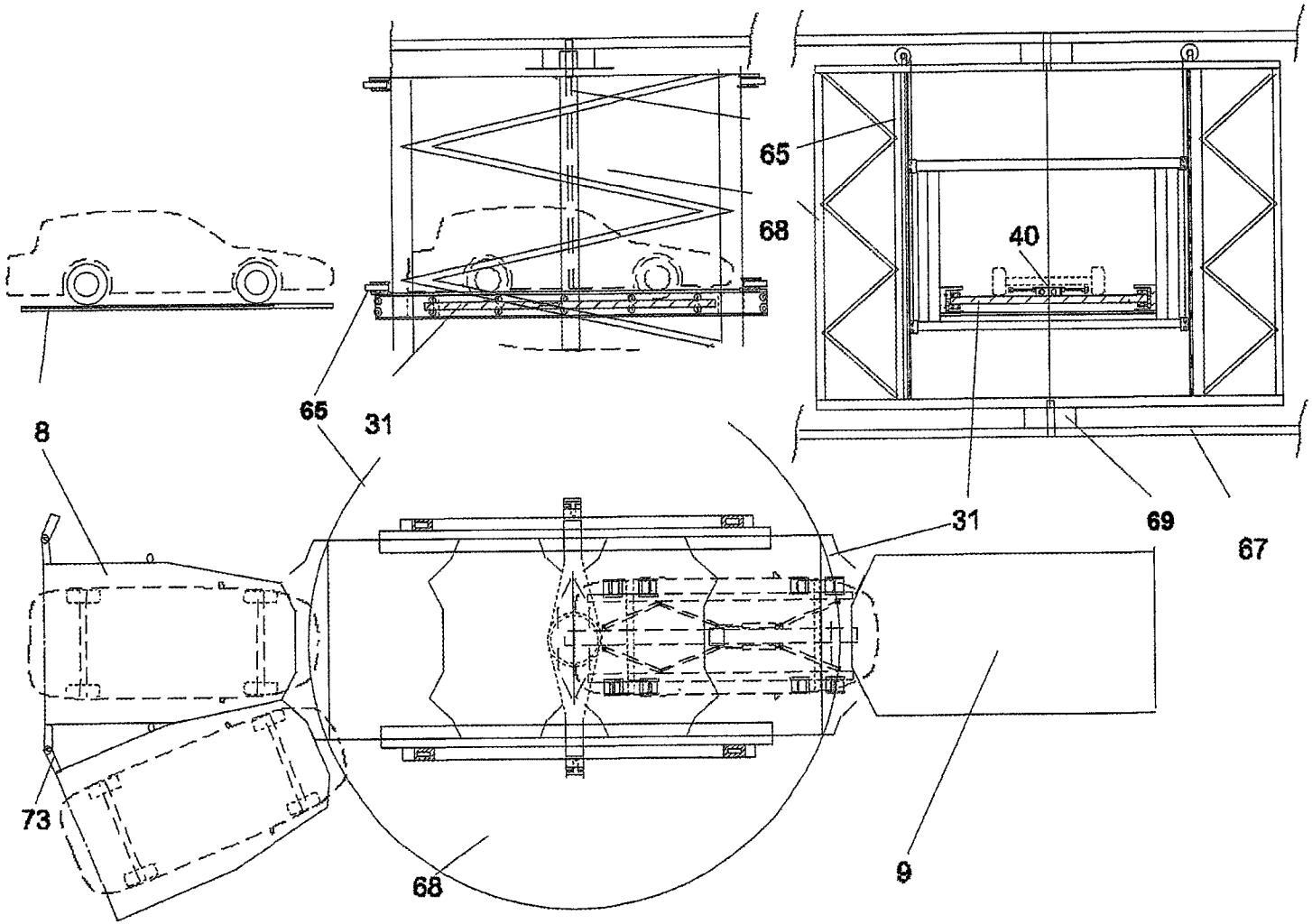
FIG. 6*b* shows the lift and lifting platform
Figure 7:
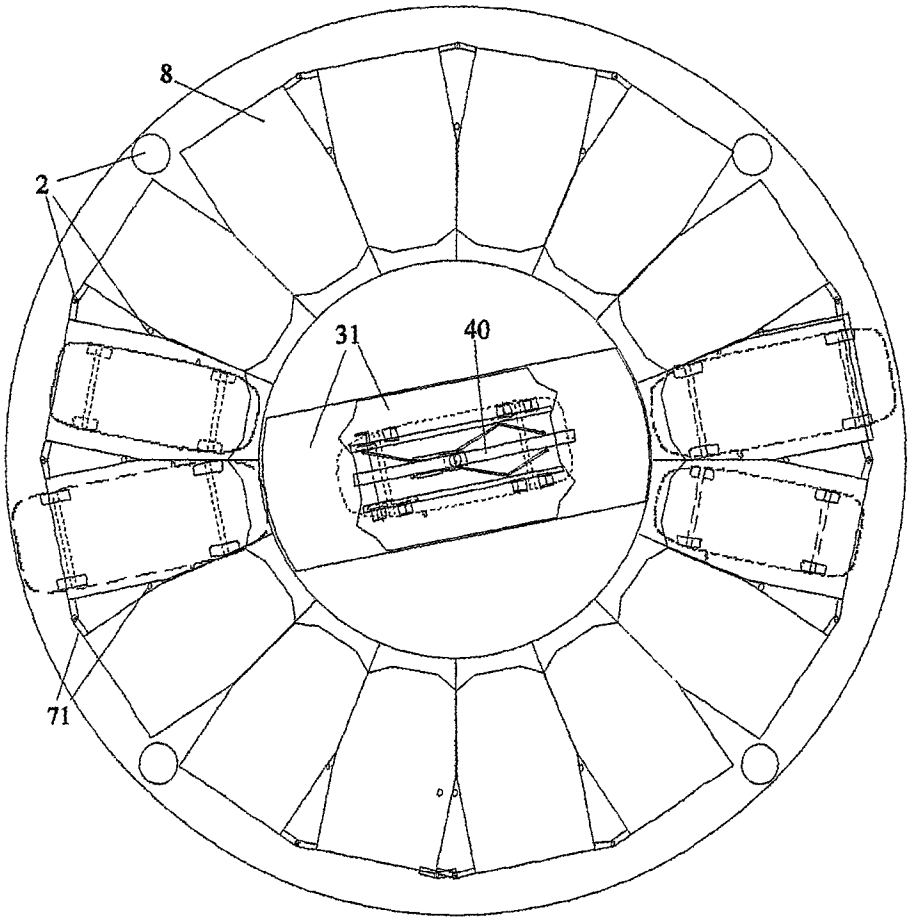
FIG. 7 shows parking arrangement, arrangement with short and long platforms.

Referring to FIGS. 3 and 6, the lifting platform (31) comprises of a plate fitted to the parking platform (8). This is placed on the rollers so that it can move horizontally lengthwise against the other platforms and can connect there. This can also be fixed permanently at the lift (at the lift cabin). Its shape is such that it connects centrally with the connecting platforms through the conical or rounded fronts and that the rollers travel over the platform thrusts without hitting. The lifting platform is mounted on a conventional lift (61). This leads to vertical guide rails (65) by means of an upper and lower rail (67) and stabilized. These vertical rails are fixed either (FIG. 6*a*) at the parking platforms (8) or (FIG. 6*b*) or, as a variant of the vertical lift carrying pillars (68), which rotate with the lift along the vertical axis. These then form the lift shaft (62). Thus rotating lift shaft, which is supported on the side with rollers (FIG. [beta]b 64) at the platforms, provides an unrestricted access to this without the hindering guide rails and supports.

The tractor is connected with the lifting platform by means of the mounting of the drive cylinder (48) and through the guide of the tractor rail (42). In case of a movable lifting platform design; so that the lifting platform (31) extending below the front of the vehicle can be moved vertically, it is retracted in the center position (platform position 2). For discharging the vehicle, the vehicle is gripped in the same way with the tractor on the parking platform, pulled on to the lifting platform and the pushed on to the other side of this (platform position 3) on the exit ramp (9).

Parking Platform

Figure 8:
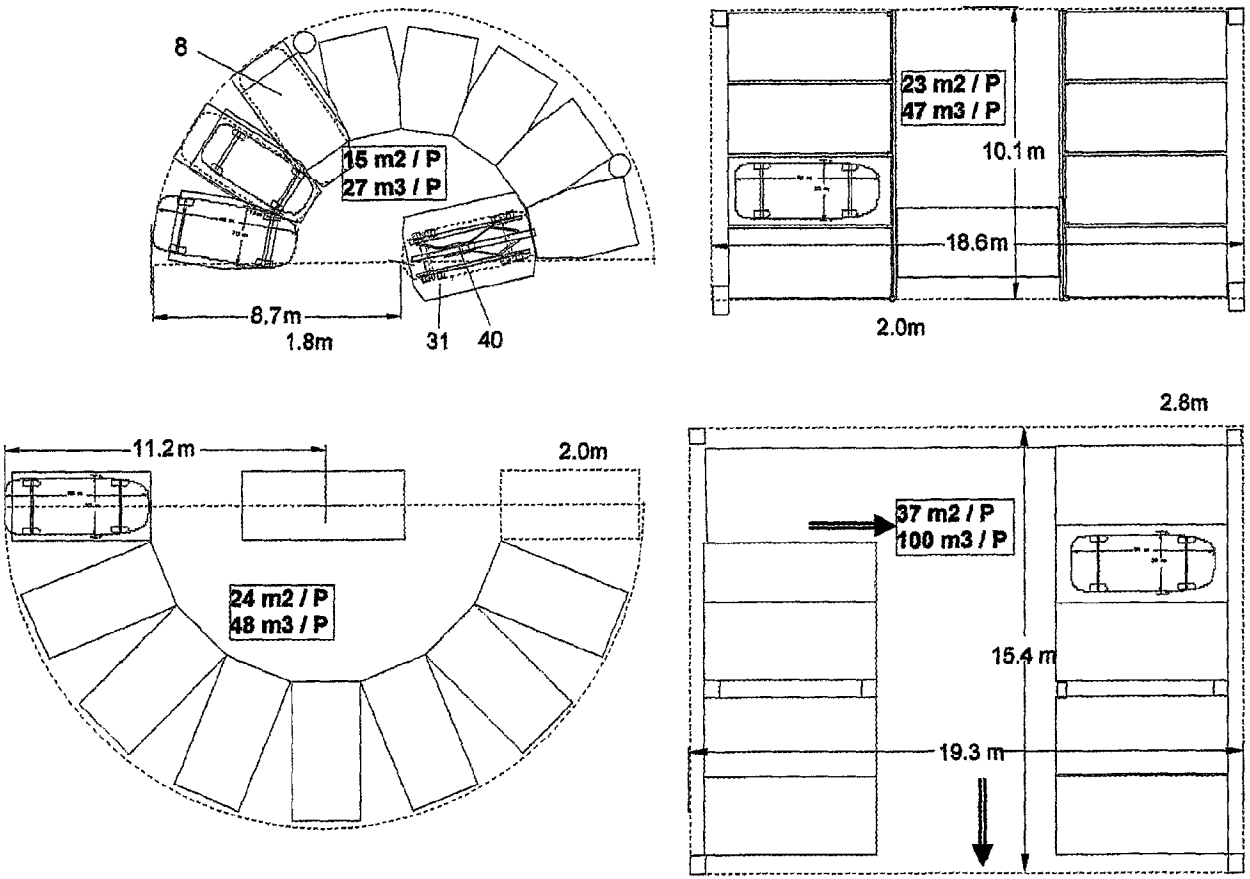
FIG. 8 shows area comparison.

Referring to FIGS. 8 and 9, the parking platform (8) comprises of conical plates (circular discs) with fixing points for suspension or supports. To ensure that these rails do not extend in the overlapping parking areas and maneuvering paths, these are placed in the rear part of the platform. The conically converging forms enable close parking. In this way, the rectangular base shapes overlap at the front corners and on the sides. Large vehicles can extend beyond the platform on the sides and the wheels can roll in and out on the adjacent platforms. In case of the movable lifting platform design: The selected front line of the platform enables on one hand the maximum lifting of the lifting platform, helps it in exact cantering during thrust and enables a smooth transfer of the rollers when the thrusts are transferred. Through the selected suspension of each individual platform no cross rails are necessary, and hence no vertical space is needed and the distance to the ceiling can be kept low. Possible horizontal reinforcements of the plates can be placed at the side margins, where enough space is available.

Parking Arrangement and Method

Referring to FIG. 8, in order that the vehicles can be parked compactly with the least utilization of space, the cars are pushed on to small, fixed parking platforms (8) in keeping with the conical or oval base forms of the front part of the cars. These are placed star-shaped in a polygon and form a circular disc. With their conically converging front section and rounding the vehicles can thus be parked compactly, in circles, with the front facing the center point of the circle. This special compact arrangement is enabled by the automatic, without using the displacement of the vehicles done through palettes, through the cantered, exact guiding of the vehicle during parking, through the computer-assisted optimization and allocation of the positions and through the selected design of the platforms. In this way the rectangular parking ground forms overlap and their paths overlap when the vehicles are being pushed in and pulled out. The conical form in the front and the short front section of the vehicle is used to reduce the distances accordingly. By means of the electronic measurement and gripping of the vehicle done in the angle, these are distributed in such a way on the parking platforms (8) that on the side of each broad car two small cars can be placed, such that the parking distances is further reduced. In this way, space is available only for the average vehicle width for each position and not for the biggest vehicle.

Calculations show that the optimum number of vehicles per deck is around 14 to 20. In case of a higher number the inner space of the circular discs becomes unnecessarily large. If the number of the parking platforms is less, the space in the center becomes too small or the space requirement for the lift and the lifting platform becomes too large as compared to the usable area.

In contrast to the conventional systems and other automated parking systems with rectangular palettes, the area requirements here is reduced considerably. No movable parts are necessary on the individual parking platforms (8), which makes the design very simple.

Alternatively, the parking platforms (8) can also be shaped and mounted closely in such a way that these form a gap-less circular disc, through which the vehicles can be parked at an angle, depending upon the width of the car, side by side with the least distance. This is enabled by placing the pillars (2) widely outside and supporting the platforms on horizontal rails.

The vertical rails (71) are present in the outer part between the parking platforms. Depending on the arrangement none or only sidewise or radial horizontal rails are necessary below the platforms. In this way, the height of the floors and hence the vertical loss of space can be ignored.

The height of the individual decks i.e. the vertical distance can be decided before mounting and, if necessary, can be adjusted to the requirement with least effort. The vertical distance is to be set for the expected vehicle height to several different deck heights. Because the deck is allocated based on the values measured for the vehicle, each vehicle would require only that much height as necessary. In this way, the space utilization efficiency is enhanced once again and the increase is about three-fold as compared to the conventional multi-storeyed car parks.

Exit Ramp and Delivery Method

The exit ramp (9) comprises of a simple plate, on which the vehicle is pushed by the tractor in the same way as on the parking platform, but in the forward direction. After the vehicle has been pushed on to it, the exit ramp is opened and made accessible to the driver. To avoid delays while driving away, several exit ramps can be placed, which can be supplemented with connecting loading zones.

Design

The lift shaft as well as the cover with the parking platforms comprise of elements that can be combined together. By means of a consistent modular design and the use of plug and screw connection, the mounting is quick and easy. In the reverse sequence, the assembly can be dismantled again. Optionally, the cover can also be fixed on to the walls of the building as a hanging or standing structure. The complete plant can be assembled above or also below the ground.

Given the fact that the user has no access to the decks, the emergency devices such as escape routes and fire-extinguishing systems, as also stairs, lifts, illumination and ventilation can be avoided to a large extent. The lift is based on commercial design with the technology used for lifts for carrying people and goods.

In summary, in this aspect the present invention provides stationary or mobile device and automatic process for compact, efficient and economical parking of private vehicles. The parking device (FIG. 1) comprising of several pillars, rails, or columns (2), to which parking platforms (8) are fixed arranged in circular discs for parking the private vehicles. At the center of this, on plates, arranged in several decks, stands or hangs a lift shaft in a conventional lift (FIG. 6A/FIG. 6B) with a fixed or movable lifting platform (31) that can be moved back and forth, on which a mechanical push system (tractor) (40) runs on a horizontal rail (tractor rail) (42), which grips the vehicles mechanically at their wheels, centers, lifts and pulls them on to the lifting platform (31). In the design with movable lifting platform this moves first in the center (position 2). Thereafter, the lift travels vertically to the assigned deck. When the lift (FIG. 6*a*, FIG. 6*b*) reaches the corresponding deck and this deck or the entire lift shaft has rotated by the calculated angle or to the platform assigned by the computer, the lifting platform is taken to this deck (position 1), in order to push the car on the parking platform with the tractor. With this method and the selected, overlapping parking arrangement (FIG. 8), the compactness can be enhanced enormously vis-a-vis the conventional systems. When removing the vehicle this is taken back by executing the steps in the reverse sequence and pushed on to the exit ramp (9) (tractor position 3).

Owing to its simplicity and modular design the device assembled, dismantled and assembled again very quickly. To do this, no other constructional measures are needed except for a connection to the power supply and a firm ground.

This system is characterized by the fact that it grips the vehicles automatically, parks them quickly and economically in a special arrangement, discharges them again when required and the entire device can be dismantled and reassembled on another location with minimal effort. Furthermore, it is also characterized by the act that the vehicles are gripped automatically, mechanically and brought to the exact initial position, in order to transport them automatically and precisely, horizontally and vertically and to rotate them on the vertical axis, without need for aids like palettes and conveyor belts.

Automatic parking system for private vehicles with fixed parking platforms (8) arranged in circular discs on several decks with a central lift (FIG. 6), the connected lifting platform (31), a push and pull device (tractor) (FIG. 4) and with parking and exit ramps, on which the vehicles are cantered and positioned automatically.

This parking system is characterized by the fact that the vehicles are gripped automatically in mechanical fashion, are measured electronically and transported with assistance of computer to specially arranged parking platforms (8), without making use of accessories like palettes, such that this parking method and the selected arrangement (FIG. 8) help to achieve an essentially higher density of the parked cars.

The design is also characterized by the fact that only a few movable parts are needed, which are restricted only to the lift (61), tractor (40), and the parking ramps (22) and the components can be combined together and screwed quickly and easily in modular layout as hanging or supporting structures, such that the entire system is mobile and can be reused.

The automatic parking system includes a parking ramp and the system is characterized by a centering system, which brings the vehicle to the middle of this ramp by means of two guide rails (21). These rails are equipped with rollers that prevent the wheels from ramming against them, without using any mechanical drive for the purpose, such that these guide rails are mechanically connected with one another through swivel arms (37), push rods (28) and cantering rails (29), which are thus in a symmetric position. These rails, kept under tension with springs (23), exercise pressure against the middle of the parking ramp, such that these are pulled away from each other in the front when the vehicle is driven in. At the same time, it results that at the back these come together symmetrically and so push the vehicle with the wheels in the middle of the driveway. The platform is also characterized by the fact that it is designed with rollers (25) laid longitudinally, on which the vehicle wheels (16) can easily be displaced to the side. As an alternative the side guide rails can also be mounted parallel and fixed, in order to keep the lateral deviation of the vehicle within limits.

The automatic parking system includes a lifting platform (31) and the system is further characterized by the fact that this on one hand can be moved forward and back horizontally, and on the other can rotate laterally along the vertical axis and also has the suitable shape and dimensions, so that it can move below the parked front of the car and can join the parking platforms (8) arranged in circle, as also the parking ramps (22) and the exit ramp (9). The lifting platform is also characterized by the fact that the tractor (40), a mechanical gripping and pushing system, is mounted on a rail which is cantered and is movable, in order to pull the vehicles on the lifting platform or to push them from this on to other platforms. As an alternative the lifting platform can be connected permanently with the lift. Similarly, as an alternative, the lift, together with the lift shaft can be designed such that it can rotate on the vertical axis. (FIG. 4*a*, 31). This is then characterized by the feature that it can be rotated with rollers between the pillars of the lift shaft (FIG. 6*b*, 65, 68 FIG. 9*c*, 68) and parking platforms guided on the side via an electromechanical, hydraulic or pneumatic drive (Z9, FIG. 9*c*, 69), electronically controlled, along the vertical axis. This ensures an exact cantering and less gaps between the lifting platform and the parking platform.

The automatic parking system is further characterized by the fact that the vehicles are gripped, cantered and moved on their wheels, without using aids like palettes or conveyor belts, when this component, hereinafter referred to as Tractor (FIG. 4, 40), is on a rail fixed in the middle of the lifting platform (31). On this, it runs below the vehicle placed on the parking ramp, presses at the wheels with two rails (forked rails) (44) that can spread, thereby centers the car exactly and raises the car to some extent with four forks (45) each having two roller fingers (46), which are pushed under the wheels, fixes the vehicle and pulls or pushes it in the desired position.

Moreover, the automatic parking system is characterized by the fact that the vehicle is gripped, lifted and pushed on each wheel with a roller fork (45), each comprising of two roller fingers (46) with horizontal rollers on its rollers (57).

This roller fork (45) is characterized by the feature that it is fixed in such a way at a rail (forked rail) (44) that its two roller fingers, comprising of one or two rollers (57) running on the platform, which carry a third roller (lifting roller) (58) and travel below the wheel of the vehicle when pulled together and lift it thereby. The lifting rollers can run either on a separate axis between and parallel to the rollers, or can be overlaid on this concentric to the roller (FIG. 5*a*, 58, FIG. 4*a*1, 46). In this case the lifting roller comprises of a segment of a roller, which runs over the roller and has the form of a segment of a barrel, on which a straight or a concave plate is set to enlarge the bearing surface of the wheel.

Furthermore, the automatic parking system has a parking arrangement and a corresponding parking platform (8), and the system is characterized by the fact that by using the conical or oval front sections of the modern automobiles, with corresponding dimensions and specific assignment of this, the vehicles can be parked compactly side by side, when these are cantered precisely and moved automatically without using palettes or similar aids, the parking platforms have a specific basic shape and an arrangement in a circular disc and at an angle of 15 to 30 degrees and the optimum space is assigned to the cars with a computer, when broad and narrow vehicles receive the corresponding parking positions. As such the arrangement is characterized by the fact that the rectangular parking areas overlap with the front edges and the side margins, and very little space is needed for maneuvering and for transporting. Furthermore, it is also possible to manage without vertical and horizontal rails, which reduce space in the usable area.

The automatic parking system for passenger cars comprise a dismountable construction consisting of one or more automatic parking ramps whereon the driver leaves his/her vehicle, the vehicle being then positioned, mechanically centered, gripped and electronically measured, automatically, so that the vehicle can be displaced by computer and compactly stored. The device consists essentially of a push system (tractor, 40) moving on a rail (tractor rail, 42), gripping the vehicles at the wheels using forks with specific rollers (45), pulling same onto the lifting platform (31) in centered position on the rollers, moving the platform vertically, rotating the platform about its vertical axis and pushing the vehicle onto the parking platform (8). On request, the vehicles are once more pulled onto the lifting platform, transported to the exit ramp and delivered to the user. The entire device consists of a reduced number of mobile components such that the construction and the use of said device are simple and economical. The inventive device uses the basic shapes of modern vehicles combined with the inventive method and a computerized allocation of places enables the space required as well as building and use costs to be considerably reduced compared to existing systems.

Entrance Gate

In a further aspect, the present invention provides an entrance gate for an automatic parking garage, and an automatic parking installation with such an entrance gate. The entrance gate enables automatic centering of a vehicle resting upon, and further enables inspection of the parking brake of the vehicle.

Such a car parking installation enables efficient, safe, economical and highly space-efficient parking of cars on down to a centimeter accuracy, on circular decks at several parking levels, which are arranged one above another. In the center, one or two lifts are installed, in order to bring the vehicles to the correct floor level and into the chosen direction for pushing them into an open space and to park it there. The vehicles will be accurately measured, that the shade of the car on the ground is determined, and thus the exact length and width and the lateral contour of the car to take account of lateral protruding outside mirrors, and also for considering the rounded front end of many cars. In addition, the maximum height is measured with a photoelectric sensor to select the required parking deck level at different heights to park a single vehicle. A sports car needs a far less height at a parking deck than a high SUV does.

Once a vehicle is deposited on the entrance gate, a robot rolls on the longitudinal centerline of the car underneath its body from the front side of the car. Four arms on the side of the robot are the extending towards the four wheels of the car, and roller fingers at the front ends of the arms swivel together and squeeze a tire in between them, thereby lifting the car slightly above the ground, preferably at least 2 centimeters (cm), more preferably about 2 to 3 cm. Then, the vehicle can be pulled by the robot without the tires of the vehicle touching the ground, that is on the rolls of the robot, into the lift platform, and later in opposite direction out of the lift platform into a selected parking lot.

However, before the robot can go into action, the car driven onto the entrance gate must be checked and centered on the entrance gate. It should be ensured that the parking brake is actuated and that such park brake does sufficiently block the car on the ground surface. The mere blocking of the car by putting the gear shift into a gear lever, or putting it on P when the car has an automatic gear is not sufficient for a reliable car blocking and will not be accepted by the parking system. Furthermore, the car, once deposited on the entrance gate, needs to be centered on it. Only then, the robot which always moves along the same line, will move exactly along the longitudinal centerline of the car, even if the car was deposited in an acute angle to the centerline of the entrance gate initially.

Therefore, in this embodiment the objective of this invention is to provide an entrance gate for an automatic parking installation which allows a reliable proof whether the parking brake is activated and brakes sufficiently, and which then perfectly centers the car on the entrance gate so that the robot can move underneath the car from its front exactly along the longitudinal centerline of the car, even if the car was initially parked on the entrance gate at an acute angle to the centerline of the entrance gate. Another objective is it to provide a parking installation with such an entrance gate which allows a reliable proof whether the parking brake is activated and brakes sufficiently, and which then perfectly centers the car on the entrance gate.

This objective is met through an entrance gate 110 of a parking installation, and also through a parking installation with such an entrance gate 110 for checking whether the parking brake is actuated and whether it is blocking the car sufficiently, and for then centering the car on the entrance gate, so that the car will stand exactly on the centerline of the entrance gate and the robot can move underneath the car exactly along the centerline of the car.

The entrance gate comprises two separate trace plates beside each other, each one for receiving thereon a front and rear wheel of a car. The trace plates are movable in the plane in any direction on top of a least one ground plates, and the trace plates are further pushable and pullable along by a drive unit in a general longitudinal direction of the trace plates. The drive unit is equipped with sensor for determining the resistance to the force used for pushing and pulling.

The entrance gate further comprises on top of these two trace plates a stationary top plate with two cut out windows. Each of the two trace plates appears in the overhead window and is movable relative to this top plate and its windows.

The entrance gate further comprises, on both sides of the top plate, a centering plate, movable toward the centerline of the top plate and also moveable in their longitudinal direction along slits. The centering plates are equipped with two stationary drive units positioned at the centerline of the entrance gate and underneath the top plate, and each one opposite an end section of these centering plates, for synchronous counter-movements of the two centering plates, so that when pulling the centering plates toward each other, the centering plates will touch the outer surface of the tires of a car resting on the trace plates and move the car toward the centerline of the entrance gate, until the longitudinal centerline of the car is positioned exactly overhead, in other words, in alignment with the centerline of the entrance gate.

Figure 10:
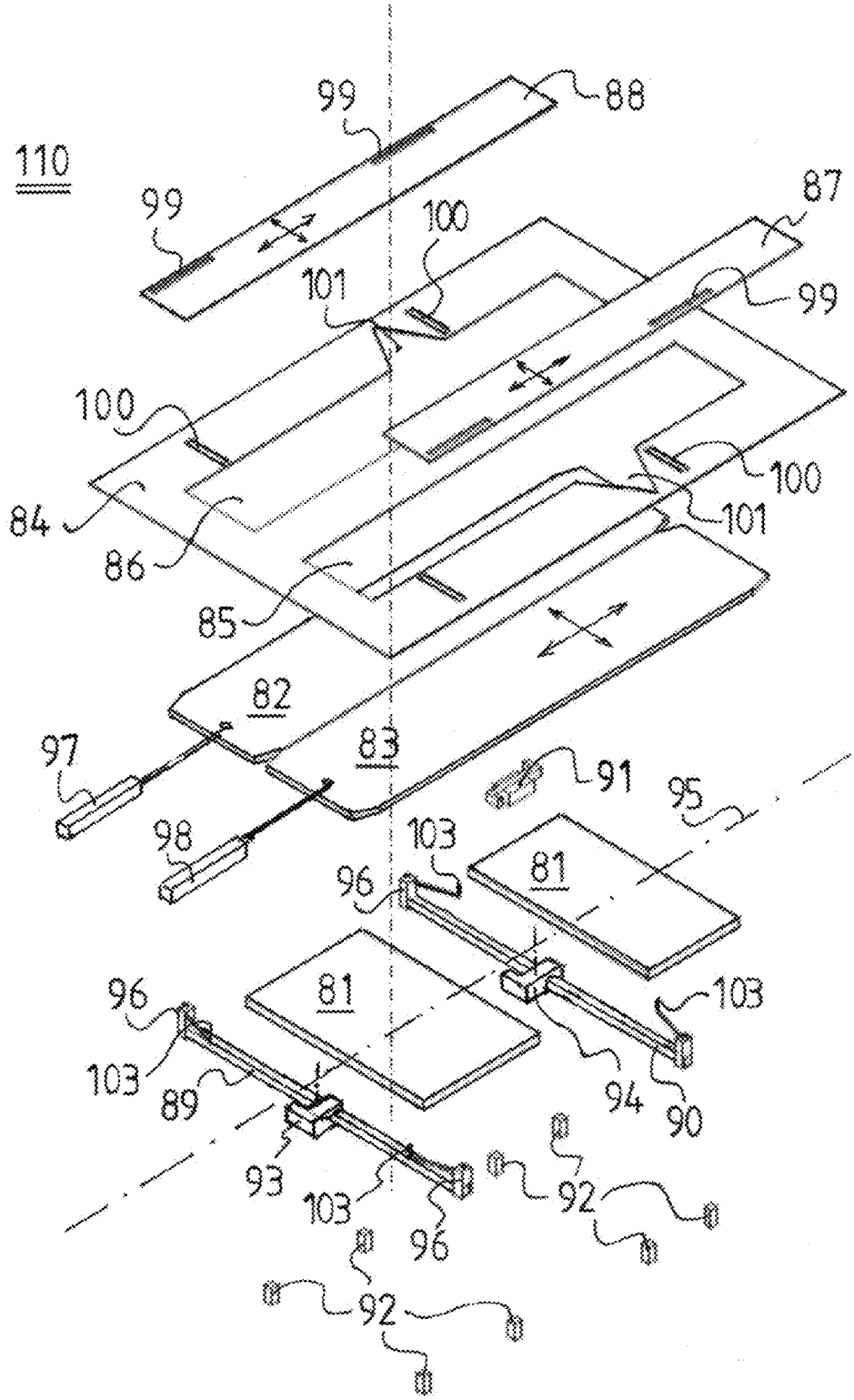
FIG. 10 shows an exploded assembly of various elements of the entrance gates in one embodiment of the present invention.

Now referring to FIGS. 10 to 15, in FIG. 10 the various parts of the entrance gate are shown. At the bottom, there are support elements 92 positioned in the concrete ground. On these support elements, the ground plates 81 rest. The drives comprise two stationary drive units 93,94 at the centerline 95 of the entire entrance gate, and arranged underneath the top plate. On both sides of each stationary drive unit 93,94, there is a jackscrew/jackshaft 89,90 extending toward the outer side of the entrance gate, shown in transverse to the longitudinal centerline of the top plate. At the ends of the jackshafts, there are connecting elements 96 to be connected to the outer edge sections of the centering plates 87,88. The connecting elements 96 have bolts 103 at their ends, extending upwards. These bolts 103 can extend within the longitudinal slits 99 along the outer edge sections of the centering plates 87,88.

When the ground plates 81 rest on the support elements 92, the stationary drive units 93,94 and their jackscrews 89,90 remain blow the top surface of the ground plates 81. On top of the ground plates 81 rest the trace plates 82,83 in a gliding manner so they can be moved in any direction. That is trace plates 82,83 can glide in any direction on the top surface of the ground plates 81, as indicated with the two arrows on trace plate 83. A lubricating grease between the trace plates 82,83 and the ground plates 81 helps moving the trace plates on the ground plates. Now, on at least one end of the trace plates 82,83, there is a drive unit 97,98 for pulling and pushing these trace plates in their longitudinal direction and for measuring the required force to do that.

On top of the trace plates 82,83, there is a stationary top plate 84, either resting on the top surface of the trace plates 82,83 so the trace plates 82,83 can glide relative to the top plate 84 along the lower side of the top plate. In an alternative construction, the plate 84 is not resting on the trace plates 82,83 but rather mounted and supported separately at its edge, with a minimal distance of, e.g. 1 mm, to these trace plates 82,83. Any small stones or dirt which may fall onto the trace plates 82,83 must be removed regularly with a vacuum cleaner. These vacuum cleaner can be part of an automatic installation so the entrance gate will be cleaned after a certain number of cycles of use.

The trace plates 82,83 are also connected to each other with a pneumatic piston/cylinder 91 (FIG. 11) so that they are always pushed away from each other to reach an initial position in which they are being set apart from each other. On top of top plate 84, along their longitudinal sides, the centering plates 87,88 rest in a gliding manner. They are guided along longitudinal slits 99, into which bolts 103 extend, and these bolts are movable also along the transverse slits 100 in the top plate 84. Therefore, the centering plates 87,88 can move in any direction on top of the top plate 84 as shown with the arrows. Triangles 101 are cut out of the outer edge of the windows 85,86 of the top plate 84. Protruding elements 102, such as bolts, are extending from the bottom side of the centering plates 87,88 down into the triangle cut outs 101 of the outer edge of the windows 85,86 in the top plate 84. Therefore, the centering plates 87,88, when moved away from each other, are always returning into a neutral initial position in relation to the top plate 84 since the protruding elements 102 are sliding along the edges of the triangle 101 cut out to their outer corner, thereby centering the centering plates in their longitudinal direction (FIG. 12).

Figure 11:
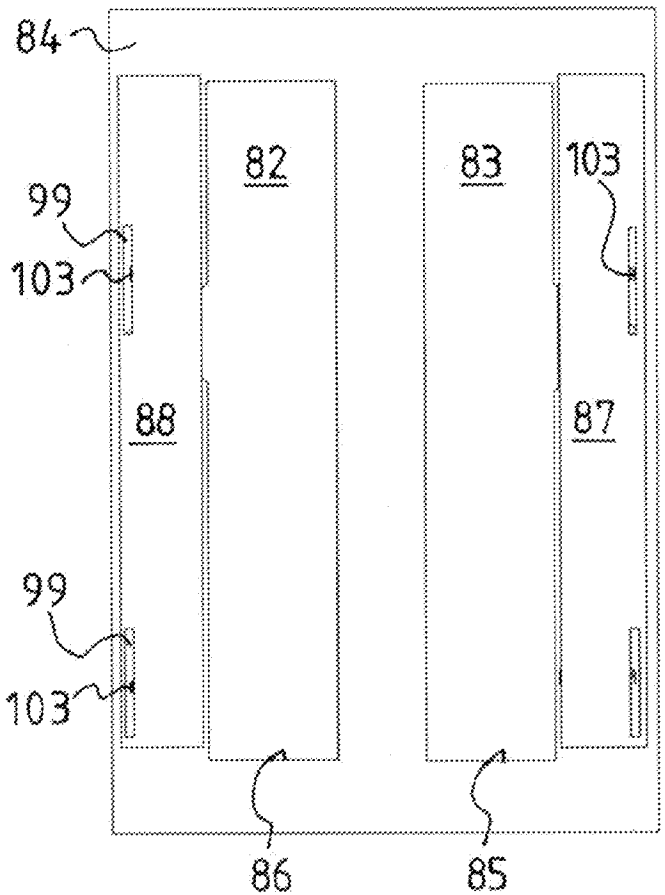
FIG. 11 is a top view of the entrance gate shown in FIG. 10.

In FIG. 11, the entrance gate is shown in a view from above. The top plate 84 with its two elongated windows 85,86 is mounted overhead the two separate trace plates 82,83. On their both outer sides, the centering plates 87,88 are laying on the top plate 84 and can glide in any direction on the top plate 84. Bolts 103 can glide along the slits 99, and they also glide along the slits 100 (shown FIG. 10) in the top plate 84, when then centering plates 87,88 are being pulled toward each other for centering a car in between, and for moving pack into their initial position as shown in FIG. 10.

Figure 12:
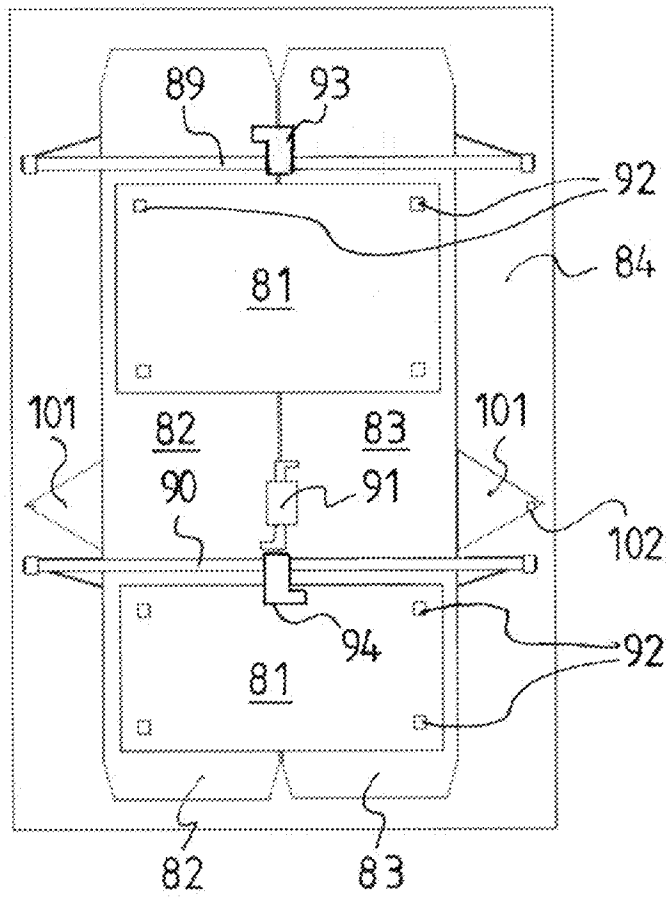
FIG. 12 is a bottom view of the entrance gate shown in FIG. 10.

In FIG. 12, entrance gate 110 is shown in a view from below. One can recognize the support elements 92, and the ground plates 81 resting on them. There are two stationary drive units 93,94, each one with jackshafts 89,90, respectively, which are extending on both sides of the stationary drive unit and which move synchronous in counter movements. If they pull the centering plate 87,88 on the one side toward the drive unit, the centering plate 87,88 on the other side will also be pulled toward the drive unit in a simultaneous movement. The trace plates 82,83 are also connected to each other with a drive unit, e.g. a pneumatic piston/cylinder 91 or by means of pushing springs, so that they are always pushed away from each other to reach an initial position in which they are being set apart from each other.

Figures 13, 14, 15:
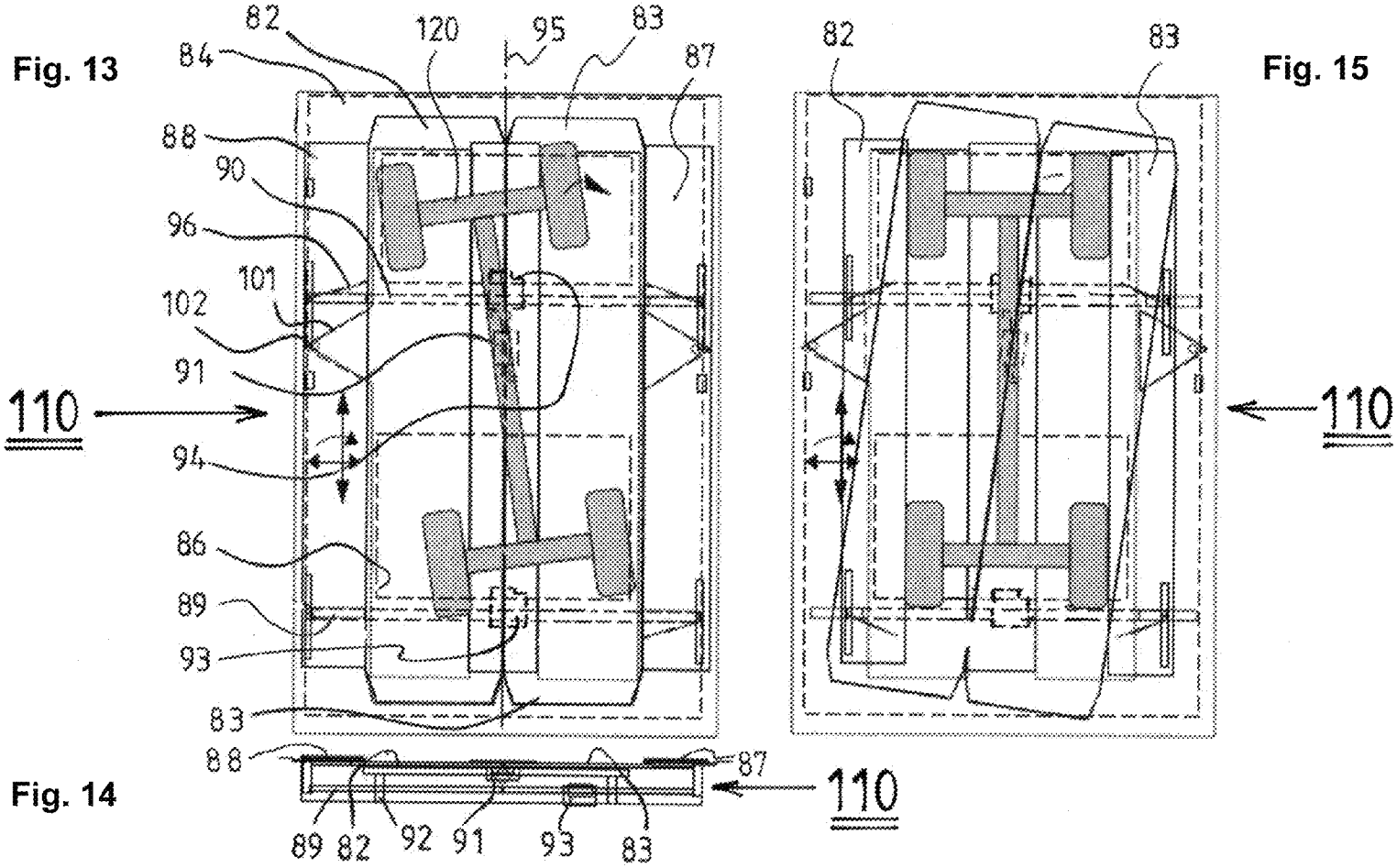
FIG. 13 shows the entrance gate of FIG. 10 with a car on it, before centering the car.
FIG. 14 is a section view of the entrance gate of FIG. 10, in the longitudinal direction.
FIG. 15 shows the entrance gate of FIG. 10 with a car on it, after centering the car.

FIG. 13 shows the initial situation, when a car 120 is rested on the entrance gate 110. Only the axles, the four wheels and the chassis bar which connects the front and rear axle are shown. The car stands with an acute angel to the centerline 95 of the entrance gate. As soon as the car is there, as a first measure, the system checks whether the parking brake is activated. For this purpose, the trace plates 82,83 are being moved by their drive units 97,98 (FIG. 10) in longitudinal direction in a counter movement to each other. While doing this, the drive units 97,98 measure the resistance force and if this resistance force does reach a certain preset value, one can be sure that the parking brake is activated. In contradiction, if only a gear would be engage, the wheels on both sides of a particular axle can move in counter movements without any substantial resistance force. This is also the case when only the gear shift is on position P in the case of an automatic gear. Once the system has checked that the parking brake is actuated and causes a sufficient resistance force, a green light and beep will signal to the driver that he can now leave his car. Next, the car will be centered automatically on the entrance gate. For doing this, the centering plates 87,88 on both sides are moving in synchronous manner toward each other. The first one which touches the outer side of a tire will henceforth push this tire and wheel toward the centerline of the entrance gate, and each centering plate, as soon as touching the outer side of a tire in likewise manner, will also push the tire and wheel toward the center-line of the entrance gate. While the car is moved for centering in this manner, the trace plates 82,83 on which the wheels rest, are gliding in the required direction until the car reaches the position as shown in FIG. 15, at which the longitudinal centerline of the car is in alignment with the centerline of the entrance gate. Now, the robot can be moved underneath the car. The robot lifts the car by lifting its tires and pulls the car away from the entrance gate into the lift platform. As soon as the trace plates 82,83 are free of a car, they are being pushed away from each other and assume an initial position for receiving the next car for inspection and centering. Also the centering plates 87,88, are being moved away from each other in order to reach their most outer position and they are at the same time being centered in their longitudinal direction for reaching an initial position.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

DRAWING NUMBER INDEX

No. Designation
2 Pillars
4 Ridge support
5 Lift shaft
6 Chassis
8 Parking platform
9 Exit platform
13 Centering spring
16 Car wheel
19 Centering rail
21 Guide rails
22 Parking ramp
23 Tension spring
25 Roll
28 Push rods
29 Centering rails
31 Lifting platform
37 Swivel arms
40 Tractor
41 Rods
42 Tractor rails
43 Slider
44 Forked rails
45 Roller fork
46 Roller finger
48 Cylinder
51 Roll fingers
53 Flange
57 Rolls
58 Lifting rollers
61 Lift
62 Lift Shaft
64 Guiding rollers Lift shaft
65 Guiding rails
66 Counter weight
67 Rail
68 Carrying pillars
69 Rotational gear of lift
71 Support of platform
71 Holder of platform
73 Pillar, support
81 Ground plates
82 Trace plate
83 Trace plate
84 Top plate
85 Cut-out window
86 Cut-out window
87 Centering plate

88 Centering plate
89 Jackshaft
90 Jackshaft
91 Drive unit or pneumatic piston/cylinder
92 Support elements
93 Stationary drive unit
94 Stationary drive unit
95 Centerline of the entire entrance gate
96 Connecting elements
97 Centering plates
98 Centering plates
99 Longitudinal slits
100 Transverse slits
101 Triangular cut-out
102 Protruding elements
103 Bolts
110 Entrance gate
120 Car

What is claimed is:

1. An entrance gate for a parking garage, comprising:

at least one stationary ground plate (81);

two separate trace plates (82,83) beside each other, each adapted to receive thereon a front and rear wheel of a car; said trace plates laid on a top surface of said stationary ground plate, movable in the plane in any direction on said top surface of said ground plate in a gliding manner;

a stationary top plate (84) disposed above said two trace plates, said top plate having two elongated cut-out windows (85,86) on opposing sides of a longitudinal centerline of said top plate and each of said two trace plates (82,83) being exposed through one of said cut-out windows; said trace plates movable relative to said top plate and said cut-out windows; and two centering plates (87,88) laid on top of said stationary top plate, disposed on two opposing outer sides of said cut-out windows; said centering plates being connected to two stationary drive units (93,94), said stationary drive units driving synchronous counter-movements of said centering plates; each centering plate movable toward said longitudinal centerline of said top plate;

wherein when said centering plates are driven toward each other by said stationary drive units, said centering plates touch outer sides of tires of the car resting on said trace plates and move the car toward a centerline (95) of said entrance gate, until a longitudinal centerline of the car is in alignment with said centerline of said entrance gate.

2. The entrance gate for a parking garage of claim 1, wherein each of said stationary drive units is connected to elongated jackshafts (89,90) extending on both sides of one said stationary drive unit, and said jackshafts move synchronous in counter movements.

3. The entrance gate for a parking garage of claim 2, wherein said centering plates are connected to said two stationary drive units by said jackshafts, with outer edge sections of said centering plates connecting to two opposing ends of said jackshafts by connecting elements (96,103).

4. The entrance gate for a parking garage of claim 3, wherein each of said centering plates includes longitudinal slits (99), said two opposing ends of said jackshafts are connected to said centering plates by said connecting elements through said longitudinal slits.

5. The entrance gate for a parking garage of claim 4, wherein said centering plates are further moveable in longitudinal direction thereof along said longitudinal slits.

6. The entrance gate for a parking garage of claim 4, wherein said top plate further comprises two pairs of transverse slits (100), each pair disposed on one of said opposing outer sides of said cut-out windows, and said centering plates are connected to said jackshafts through said two pairs of transverse slits.

7. The entrance gate for a parking garage of claim 1, wherein said top plate further comprises two opposing triangular cut-outs (101), each extending outward from one of said cut out windows; and a protruding element (102) on a bottom side of each of said centering plates extends into one of said triangular cut-outs.

8. The entrance gate for a parking garage of claim 1, wherein said trace plates are connected to a second drive unit (97,98) and are pushable and pullable in a general longitudinal direction of said trace plates by said second drive unit; and said second drive unit is equipped with a sensor adapted to determine a resistance force against a counter movement between said trace plates in said longitudinal direction thereof affected by said second drive unit.

9. The entrance gate for a parking garage of claim 1, wherein said trace plates are connected to each other with a further drive unit (91), said further drive unit pushes said two trace plates apart from each other.

10. An automatic parking installation comprising:

(a) an entrance gate (110) comprising:

at least one stationary ground plate (81);

two separate trace plates (82,83) beside each other, each adapted to receive thereon a front and rear wheel of a car; said trace plates laid on a top surface of said stationary ground plate, movable in the plane in any direction on said top surface of said ground plate in a gliding manner;

a stationary top plate (84) disposed above said two trace plates, said top plate having two elongated cut-out windows (85,86) on opposing sides of a longitudinal centerline of said top plate and each of said two trace plates (82,83) being exposed through one of said cut-out windows; said trace plates movable relative to said top plate and said cut-out windows; and two centering plates (87,88) laid on top of said stationary top plate, disposed on two opposing outer sides of said cut-out windows; said centering plates being connected to two stationary drive units (93,94), said stationary drive units driving synchronous counter-movements of said centering plates; each centering plate movable toward said longitudinal centerline of said top plate;

wherein when said centering plates are driven toward each other by said stationary drive units, said centering plates touch outer sides of tires of the car rested on said trace plates and move the car toward a centerline (95) of said entrance gate, until a longitudinal centerline of the car is in alignment with said centerline of said entrance gate; and (b) a robot (40) adapted to move along said centerline of said entrance gate, said robot comprising four roller forks (45), each having two roller fingers (46), wherein said robot rolls underneath said car centered along said centerline of said entrance gate, said roller fingers (46) of each fork move together to squeeze on a tire of said car between said roll fingers, thereby lift said car slightly above said trace plates, and said robot moves said car into a lift platform (31) without said tires of said car touching the ground.

11. The automatic parking installation of claim 10, wherein said trace plates are connected to a second drive unit (97,98) and are pushable and pullable in a general longitudinal direction of said trance plates by said second drive unit; and said second drive unit is equipped with a sensor adapted to determine a resistance force against a counter movement between said trace plates in said longitudinal direction thereof affected by said second drive unit.

12. The automatic parking installation of claim 10, wherein said lift platform includes one or more rails adapted to engage with said robot, and said lift platform is adapted to move vertically within said parking installation to transport said car.

13. The automatic parking installation of claim 10 further comprising multiple decks disposed one above another vertically, and each deck comprising multiple parking platforms (8).

14. The automatic parking installation of claim 13, wherein each parking platform has one or more rails adapted to engage with said robot.

15. The automatic parking installation of claim 13, wherein said multiple decks are arranged in a circular shape with said multiple parking platforms surrounding a central space.

16. A method of parking a car in an automatic parking installation, comprising:

(a) receiving a car on an entrance gate, said entrance gate comprising at least one stationary ground plate;

two separate trace plates beside each other, each adapted to receive thereon a front and rear wheel of a car; said trace plates laid on a top surface of said stationary ground plate, movable in the plane in any direction on said top surface of said ground plate in a gliding manner;

a stationary top plate disposed above said two trace plates, said top plate having two elongated cut-out windows on opposing sides of a longitudinal centerline of said top plate and each of said two trace plates being exposed through one of said cut-out windows; said trace plates movable relative to said top plate and said cut-out windows; and two centering plates laid on top of said stationary top plate, disposed on two opposing outer sides of said cut-out windows; said centering plates being connected to two stationary drive units, said stationary drive units driving synchronous counter-movements of said centering plates; each centering plate movable toward said longitudinal centerline of said top plate;

as received, tires of the car resting on areas of said trace plates exposed through said cut-out windows;

(b) activating said stationary drive units to drive said centering plates toward each other, thereby said centering plates touch outer sides of tires of the car resting on said trace plates, and move the car toward a centerline of said entrance gate until a longitudinal centerline of the car is in alignment with said centerline of said entrance gate; and (c) moving a robot underneath the car along said centerline of said entrance gate, activating four roller forks of said robot to cause roller fingers of each of said forks moving together to squeeze on one tire of the car between said roller fingers, and lifting the car slightly above the trace plates;

(d) rolling said robot out from said entrance gate and into a lift platform without said tires of the car touching the ground;

(e) moving said lift platform vertically to one level of multiple decks, next to a parking space; and (f) rolling said robot into said parking space, and lowering the car to have said tires resting on said parking space.

17. The method of claim 16 further comprising:

prior to step (b), activating a second drive unit connected to said trace plates to cause a counter movement between said trace plates in a longitudinal direction thereof;

measuring a resistance force of said trace plates against said counter movement; and indicating acceptable parking brake if measured resistance force exceeds a predetermined threshold.

18. The method of claim 17 further comprising:

rolling said robot out from said lift platform; and repeating step (c) to transport another car received on said entrance gate.

19. The method of claim 16 further comprising:

retrieving said robot back into said lift platform; and descending said lift platform to the ground.

20. The method of claim 16, wherein said robot lifts the car at least 2 centimeters above said trace plates.

* * * * *